US012667238B2

(12) United States Patent
Nguyen et al.

(10) Patent No.: US 12,667,238 B2
(45) Date of Patent: Jun. 30, 2026

(54) SURFACE CLEANING APPARATUS WITH STEAM DELIVERY

(71) Applicant: BISSELL Inc., Grand Rapids, MI (US)

(72) Inventors: Tom Minh Nguyen, Grand Rapids, MI (US); Joseph D. Fordahl, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 418 days.

(21) Appl. No.: 18/117,653

(22) Filed: Mar. 6, 2023

(65) Prior Publication Data

US 2023/0284857 A1 Sep. 14, 2023

Related U.S. Application Data

(60) Provisional application No. 63/318,911, filed on Mar. 11, 2022.

(51) Int. Cl.

| | |
|---|---|
| ***A47L 11/34*** | (2006.01) |
| ***A47L 7/00*** | (2006.01) |
| ***A47L 9/24*** | (2006.01) |
| ***A47L 9/32*** | (2006.01) |
| ***A47L 11/40*** | (2006.01) |
| ***F24H 1/10*** | (2022.01) |

(52) U.S. Cl.

CPC ..... *A47L 11/34* (2013.01); *A47L 7/0009* (2013.01); *A47L 7/0023* (2013.01); *A47L 9/248* (2013.01); *A47L 9/327* (2013.01); *A47L 11/4016* (2013.01); *A47L 11/4083* (2013.01); *A47L 11/4086* (2013.01); *A47L 11/4088* (2013.01); *F24H 1/101* (2013.01)

(58) Field of Classification Search

CPC .... A47L 13/225; A47L 11/4086; A47L 11/34; A47L 7/0023; A47L 7/0009; A47L 11/4044; A47L 7/0004; A47L 9/248; A47L 9/327; A47L 11/4016; A47L 11/4083

USPC ..... 15/322

See application file for complete search history.

(56) References Cited

U.S. PATENT DOCUMENTS 4,083,077 A 4/1978 Knight et al.
5,613,271 A * 3/1997 Thomas ..... A47L 11/4086 15/322

(Continued)

FOREIGN PATENT DOCUMENTS

CN 101101111 A * 1/2008 ..... F22B 1/288
CN 212108331 U 12/2020

(Continued)

OTHER PUBLICATIONS

Translation of KR-101369220-B1 (Year: 2025).*
Translation of CN-101101111-A (Year: 2025).*

*Primary Examiner* — Monica S Carter
*Assistant Examiner* — Sarah Akyaa Fordjour
(74) *Attorney, Agent, or Firm* — Warner Norcross + Judd LLP

(57) ABSTRACT

The present disclosure provides a surface cleaning apparatus that includes steam delivery. The apparatus includes a hand-carried body adapted to be hand-carried by a user, the hand-carried body including a supply tank, a recovery tank, a liquid supply pump, a steam supply pump, a heater, and a suction source including a vacuum motor. A flexible hose is mounted to the hand-carried body and a hand-held cleaning tool mounted to an end of the hose.

19 Claims, 19 Drawing Sheets

(56) References Cited

U.S. PATENT DOCUMENTS

| | | | | |
|---|---|---|---|---|
| 6,148,144 | A * | 11/2000 | Milanese | A47L 11/4075 392/405 |
| 6,934,995 | B2 | 8/2005 | Wheeler et al. | |
| 7,073,226 | B1 * | 7/2006 | Lenkiewicz | A47L 11/4083 15/327.2 |
| 7,228,589 | B2 * | 6/2007 | Miner | A47L 11/34 15/385 |
| 7,380,307 | B2 | 6/2008 | Tsai | |
| 7,757,341 | B2 | 7/2010 | Bober et al. | |
| 8,528,161 | B2 | 9/2013 | Vrodoljak et al. | |
| 8,549,697 | B1 | 10/2013 | Moyher, Jr. et al. | |
| 9,351,623 | B2 | 5/2016 | Carter | |
| 9,615,703 | B2 | 4/2017 | Moyher, Jr. et al. | |
| 9,968,235 | B2 | 5/2018 | Vail et al. | |
| 10,376,124 | B2 | 8/2019 | McDowell et al. | |
| 10,548,450 | B2 | 2/2020 | Hess et al. | |
| 10,694,914 | B2 | 6/2020 | McGee et al. | |
| 10,986,975 | B2 | 4/2021 | Rukavina et al. | |
| 2008/0022480 | A1 * | 1/2008 | Lee | B08B 3/00 15/320 |
| 2014/0041147 | A1 | 2/2014 | Pagoria et al. | |
| 2020/0205624 | A1 | 7/2020 | Rukavina et al. | |
| 2021/0153709 | A1 | 5/2021 | Luyckx | |

FOREIGN PATENT DOCUMENTS

| | | | |
|---|---|---|---|
| CN | 306986003 | S | 12/2021 |
| CN | 216048318 | U | 3/2022 |
| CN | 216262243 | U | 4/2022 |
| CN | 216628360 | U | 5/2022 |
| CN | 216628430 | U | 5/2022 |
| CN | 216628431 | U | 5/2022 |
| CN | 216876265 | U | 7/2022 |
| CN | 217090590 | U | 8/2022 |
| EP | 1223844 | B1 | 7/2004 |
| EP | 3315023 | B1 | 5/2018 |
| EP | 3824786 | | 5/2021 |
| EP | 3016566 | B1 | 12/2022 |
| IN | 216628359 | U | 5/2022 |
| KR | 101369220 | B1 * | 3/2014 |

* cited by examiner

SURFACE CLEANING APPARATUS WITH STEAM DELIVERY

CROSS-REFERENCE TO RELATED APPLICATION(S)

This application claims the benefit of U.S. Provisional Application No. 63/318,911, filed Mar. 11, 2022, which is incorporated herein by reference in its entirety.

BACKGROUND

Extractors are well-known surface cleaning devices for deep cleaning carpets and other fabric surfaces, such as upholstery. Most extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a conduit, and a source of suction in fluid communication with the conduit to draw the cleaning fluid from the surface to be cleaned and through the nozzle and the conduit to the recovery tank. Other wet cleaning apparatuses include steam cleaners that dispense steam, and spot cleaners that may dispense liquid and scrub the surface, but do not recover liquid.

Extractors and other wet cleaners can be adapted to be hand-carried by a user, and in some cases include a hose coupled with a tool carrying the fluid distributor and nozzle.

BRIEF SUMMARY

A surface cleaning apparatus with steam delivery is provided herein. In certain embodiments, the surface cleaning apparatus is a portable extraction cleaner or portable deep cleaner adapted to be hand-carried by a user to carpeted areas of cleaning relatively small areas, such as small rugs and upholstery. Steam delivery can be provided through a hand tool of the portable extraction cleaner.

According to one aspect of the disclosure, the apparatus includes a hand-carried body adapted to be hand-carried by a user, the hand-carried body having a main housing, a supply tank, a recovery tank, a liquid supply pump, a steam supply pump, a heater, and a suction source including a vacuum motor, a flexible hose assembly mounted to the hand-carried body, and a hand-held cleaning tool mounted to an end of the hose.

According to another aspect of the disclosure, the hand-carried body includes a base adapted to rest on a floor surface and a partition extending upwardly from the base, and the heater and the vacuum motor are at least partially disposed within the partition, and are between the supply tank and the recovery tank.

According to yet another aspect of the disclosure, the heater is a vertically-oriented steam generator, with a lower end of the heater below an upper end of the heater, and a heater inlet and a heater outlet are disposed at the lower end of the heater.

According to still another aspect of the disclosure, the recovery tank includes a recovery container, a lid on the recovery container, an intake port in the lid, and an exhaust port in the lid. The hand-carried body can have a recovery tank receiver with an intake duct in fluid communication with the hose and an exhaust duct in fluid communication with the suction source, whereby mounting of the recovery tank in the recovery tank receiver couples the intake port with the intake duct and the exhaust port with the exhaust duct.

In another aspect of the disclosure, the apparatus has a hose coupler, and the flexible hose assembly has an adaptor removably coupled with the hose coupler to establish continuous flow paths for liquid delivery, steam delivery, and extraction between the hand-carried body and the hose assembly.

In yet another aspect of the disclosure, a wand is coupled with an end of the hose and includes a liquid distributor to deliver liquid cleaning fluid and a steam distributor to deliver steam. A tool head is coupled with the wand and includes a dispensing window, wherein the liquid and steam distributors are in register with the dispensing window to deliver liquid and steam through the dispensing window.

The embodiments of a surface cleaning apparatus with steam disclosed herein enable a better cleaning experience. Selectively dispensing steam when and where it is needed provides a better spot and stain cleaning experience.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The disclosure generally relates to a surface cleaning apparatus with steam delivery. Aspects of the disclosure described herein relate to a surface cleaning apparatus that delivers cleaning fluid to a surface to be cleaned, such as an extraction cleaner that also extracts cleaning fluid and debris from the surface. Aspects of the disclosure described herein are further related to a portable extraction cleaner (e.g. a deep cleaner) that is adapted to be hand-carried by a user to carpeted, upholstered, and other areas for cleaning relatively small areas.

Figure 1:
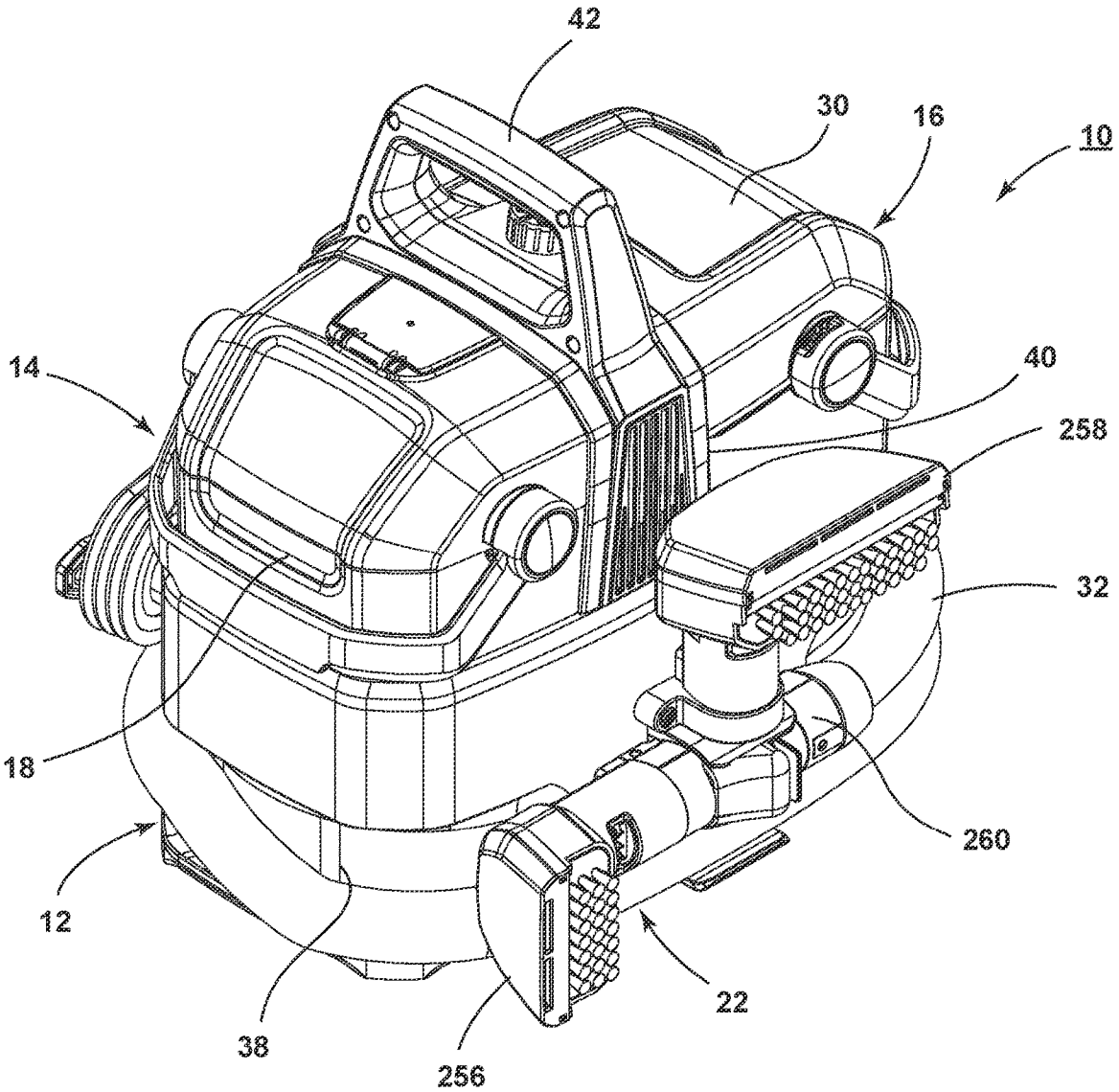
FIG. 1 is a front perspective view of a portable extraction cleaner with steam dispensing, with a hose assembly wrapped around a main housing or pod for storage.
Figure 2:
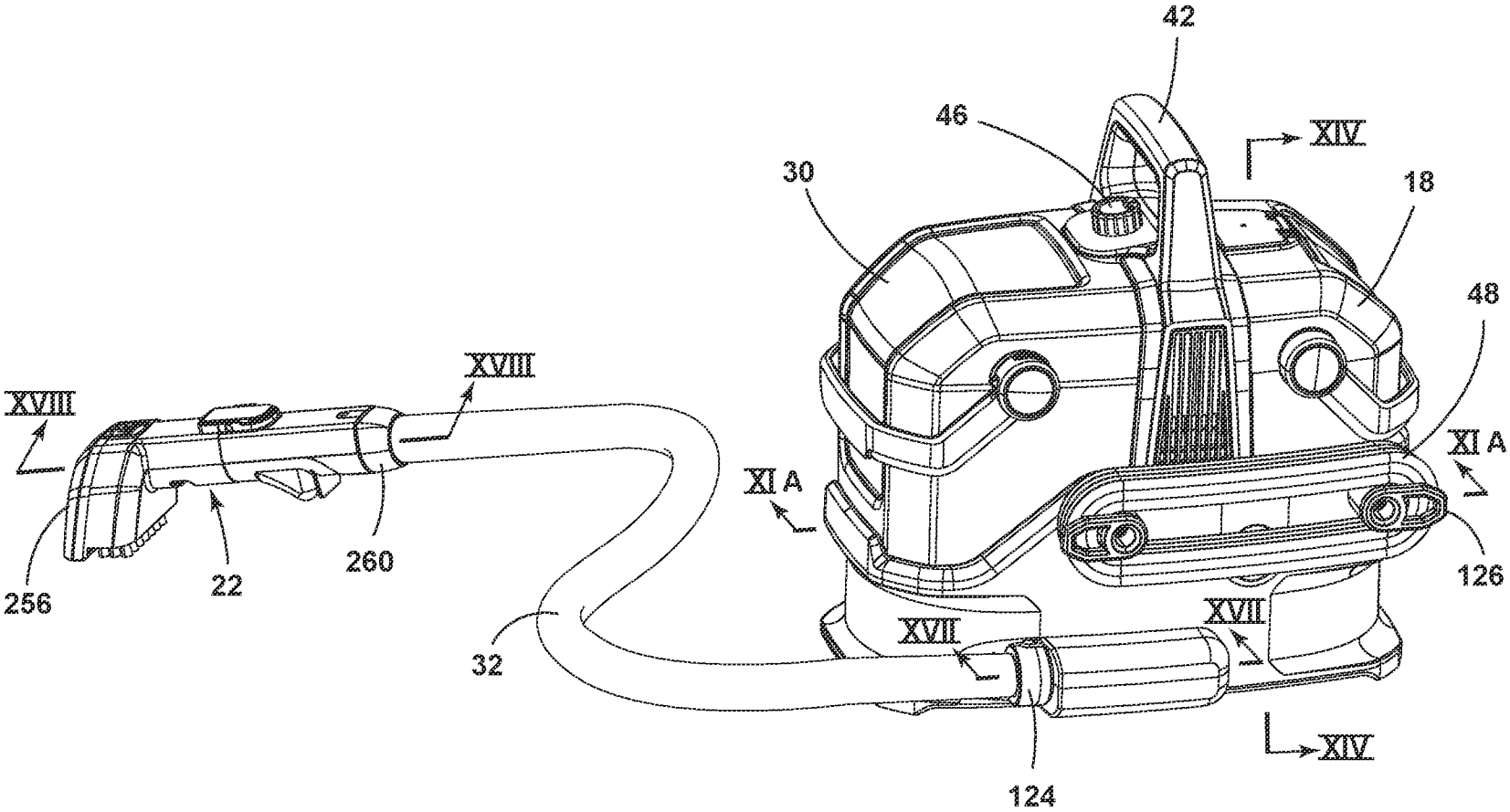
FIG. 2 is a rear perspective view of the portable extraction cleaner, with a hose assembly unwrapped from the main housing.

FIGS. 1-2 show a surface cleaning apparatus with steam delivery in the form of a portable extraction cleaner 10 according to one aspect of the invention. The extraction cleaner 10 includes a hand-carried body or pod including a main housing 12, a fluid delivery system 14 configured to store cleaning fluid and to deliver the cleaning fluid to the surface to be cleaned, and a fluid recovery system 16 configured to remove the fluid and debris from the surface to be cleaned and to store the recovered fluid and debris.

The fluid delivery system 14 can more particularly be a liquid/steam delivery system 14 configured to store cleaning fluid and to deliver the cleaning fluid to the surface to be cleaned as liquid, steam, or both. The portable extraction cleaner 10 is provided with various features and improvements related to steam delivery, which are described in further detail below.

For purposes of description related to the figures, the terms upper, lower, vertical, horizontal, and derivatives thereof shall relate to the exemplary extraction cleaner 10 as oriented in FIG. 1, which can apply to the extraction cleaner 10 resting on a surface or being carried by the carry handle. However, it is to be understood that aspects of the present disclosure may assume various alternative orientations, except where expressly specified to the contrary.

The main housing 12 is adapted to selectively mount components of the fluid delivery system 14 and the fluid recovery system 16 to form an easy-to-carry unit that can be transported by a user to different locations with surfaces to be cleaned. The extraction cleaner 10 is adapted to be hand-carried by a user to carpeted areas for cleaning relatively small areas and extract cleaning fluid and debris from the surface. Additional, non-limiting examples of areas that can be cleaned include area rugs, upholstery, vehicle interiors, drapery, and mattresses. In some embodiments, the extraction cleaner 10 can comprise a wheeled main housing 12, such that the main housing 12 can travel over a surface on wheels in addition to or instead being being hand-carried.

Figure 3:
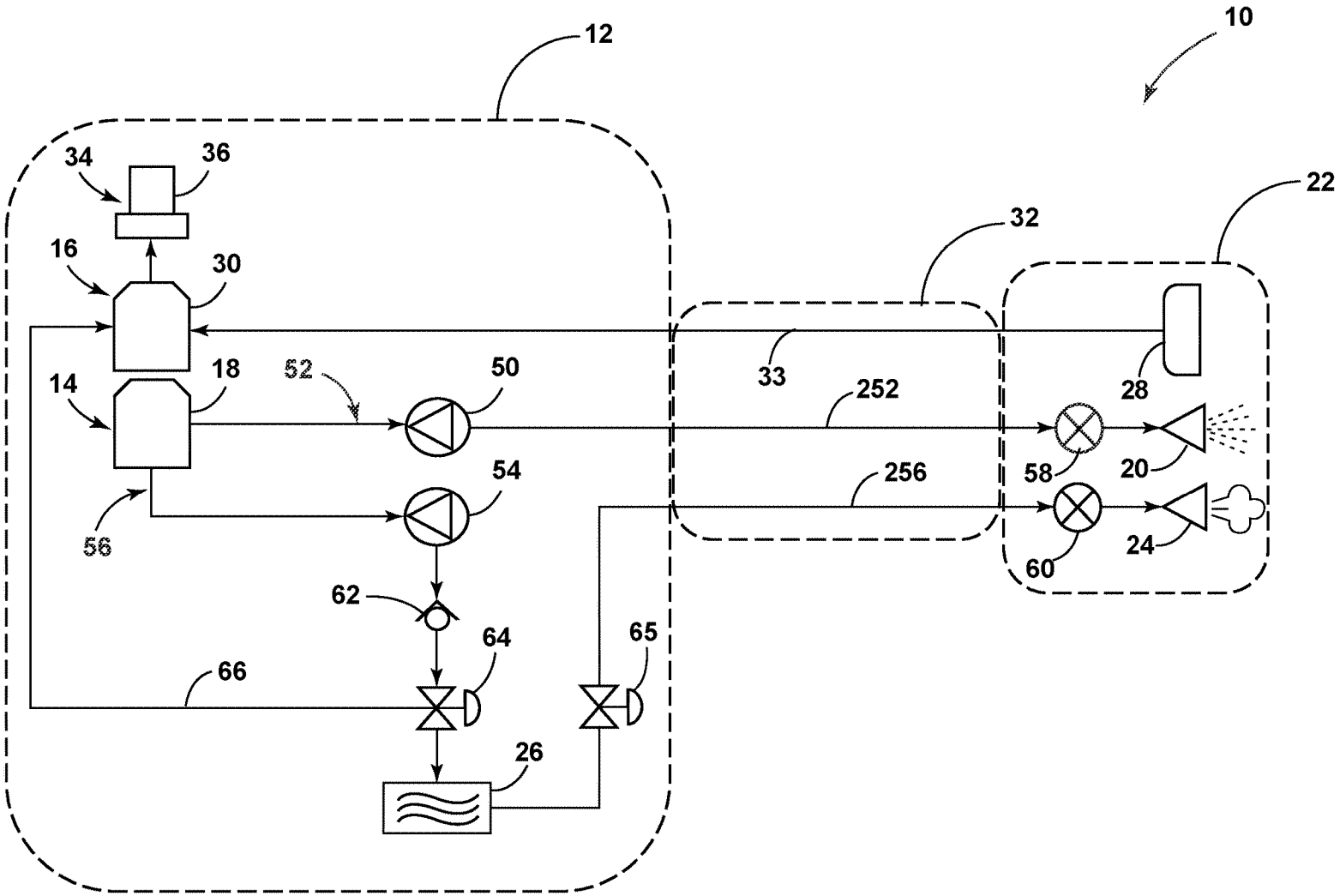
FIG. 3 is a schematic view of the portable extraction cleaner.

Referring to FIG. 3, the fluid delivery system 14 can include a supply tank 18 for storing a supply of cleaning fluid, a liquid distributor 20 remote from the main housing 12, and a steam distributor 24 remote from the main housing 12. A heater 26 is provided in the flow path between the supply tank 18 and the steam distributor 24 to heat the cleaning fluid to produce steam.

In one embodiment, the distributors 20, 24 are disposed at a hand-held cleaning tool 22 coupled with the main housing by a flexible hose 32. The tool 22 may include, in one aspect, a wand 260 and having an interchangeable tool head 256. The distributors 20, 24 can be provided on the wand 260 or on the tool head 256.

The cleaning fluid stored by the supply tank 18 can comprise one or more of any suitable cleaning liquids, including, but not limited to, water, compositions, concentrated detergent, diluted detergent, etc., and mixtures thereof. For example, the fluid can comprise a mixture of water and concentrated detergent. The cleaning fluid can be stored in liquid form.

The supply tank 18 can be refillable, and can be formed of a transparent or tinted translucent material, which permits a user to view the contents thereof. The supply tank 18 can be removably mounted on the main housing 12.

The heater 26 preferably heats the cleaning fluid to about 100° C., where "about" includes ±10° C. This temperature may be the temperature at the steam distributor 24. Since some heat loss between the outlet of the heater 26 and the steam distributor 24 is possible, the setpoint of the heater 26 may be higher. One non-limiting example of a setpoint for the heater 26 is from about 165° C. to about 180° C. Some non-limiting examples of a suitable heater 26 include, but are not limited to, a flash heater, a boiler, an immersion heater, and a flow-through steam generator.

The heater 26 may produce steam. As used herein, the term "steam" includes a cleaning fluid such as but not limited to water or solutions containing water (like water mixed with a cleaning chemistry, fragrance, etc.), at least partially converted to a gas or vapor phase. The cleaning fluid can be boiled or otherwise at least partially converted to the gas or vapor phase by heating. The cleaning fluid can be heated to around 100±10° C., alternately about 90° C. to 100° C., alternatively about 95° C. to 98° C. The steam produced by the heater 26 can have a steam quality of 100% or less, alternatively about 70% or greater, alternatively about 75% or greater, alternatively about 80% or greater, alternatively about 85% or greater, alternatively about 90% or greater, alternatively about 95% or greater, alternatively about 70-100%. As used herein, "steam quality" is the proportion of saturated steam in a saturated condensate (liquid) and steam mixture. For example, saturated steam vapor has a steam quality of 100%, and saturated liquid has a steam quality of 0%.

It is understood that, in some embodiments, the temperature and/or steam quality may change between the heater 26 and the steam distributor 24, with heat loss and/or condensation lowering the temperature and/or steam quality of steam output by the steam distributor. In other embodiments, the temperature and/or steam quality may be substantially the same at the heater 26 and at the steam distributor 24.

For example, the heater 26 may have a setpoint in the range of about 165° C. to about 180° C., however, the fluid dispensed by the steam distributor 24 (after traveling along about 5-6 foot of tubing between an outlet of the heater 26 and the steam distributor 24) may comprise steam having a steam quality less than about 100% and having a temperature of less than about 100° C. For example, the steam dispensed by the steam distributor 24 can have a steam quality in a range of from about 70% to about 100%, and can have a temperature in a range of from about 90° C. to about 100° C., about 90° C. to about 99° C., about 90° C. to about 98° C., about 90° C. to about 97° C., about 90° C. to about 96° C., about 90° C. to about 95° C., about 90° C. to about 94° C., about 94° C. to about 100° C., about 94° C. to about 99° C., about 94° C. to about 98° C., about 94° C. to about 97° C., about 94° C. to about 96° C., about 94° C. to about 95° C., about 95° C. to about 100° C., about 95° C. to about 99° C., about 95° C. to about 98° C., about 95° C. to about 97° C., about 95° C. to about 96° C., about 96° C. to about 100° C., about 96° C. to about 99° C., about 96° C. to about 98° C., about 96° C. to about 97° C., about 97° C. to about 100° C., about 97° C. to about 99° C., about 97° C. to about 98° C., about 98° C. to about 100° C., about 98° C. to about 99° C., or about 99° C. to about 100° C. Without being limited by any theory, the difference in steam quality and temperature of the fluid exiting the heater 26 and the fluid dispensed from the steam distributor 24 may be due at least in part to loss of heat to the surrounding environment as the fluid travels between heater 26 and the steam distributor 24.

The fluid recovery system 16 can include an extraction path in the form of an extraction nozzle 28 provided on the cleaning tool 22, which is adapted to be used on the surface to be cleaned, a recovery tank 30, and a flexible hose 32 defining a portion of a vacuum or suction conduit 33 in fluid communication with the extraction nozzle 28 and the recovery tank 30. The recovery tank 30 can be removably mounted on the main housing 12.

The fluid recovery system 16 further includes a suction source 34, for example in the form of a motor/fan assembly including a vacuum motor 36, in fluid communication with the extraction nozzle 28 for generating a working airflow to draw liquid and entrained debris through the extraction path. The suction source 34 can be provided fluidly downstream of the recovery tank 30, although other extraction paths are possible.

Referring to FIGS. 1-2, various arrangements for the housing 12 and tanks 18, 30 are possible. In one arrangement, the main housing 12 can include a carry handle 42 to form an easy-to-carry unit with the supply and recovery tanks 18, 30 that can be transported by a user to different locations with surfaces to be cleaned. The main housing 12 can further include a base 38 on which the supply and recovery tanks 18, 30 are at least partially supported, and a partition 40 extending upwardly from the base 38, between the supply and recovery tanks 18, 30. The partition 40 can comprise an enclosure housing one or more components of the extraction cleaner 10, such as the heater 26 and the suction source 34.

In FIG. 1, the hand-held tool 22 and hose 32 are shown stored on the main housing 12, for example with the hose 32 wrapped around the base 38 and the tool 22 clipped or otherwise attached to the housing 12. In FIG. 2, the hand-held tool 22 and hose 32 are shown in one non-limiting example of a use or operational position, where the tool 22 is free of the housing 12 and the hose 32 is unwrapped from the base 38, through still attached to the housing 12.

Optionally, more than one hand-held cleaning tool or tool accessory can be provided with the extraction cleaner 10. In the embodiment shown, one tool head 256 is shown connected with the wand 260 and a second tool head 258 is shown stored on the main housing 12 and may be interchangeable mounted on the wand 260. The different tool heads 256, 258 can be configured to optimally perform different cleaning tasks. By way of non-limiting example, the first tool head 256 may have a smaller width (e.g., 3 inches) to clean smaller areas or tight spaces and the second tool head 258 may have a larger width (e.g., 5 inches) to clean larger areas.

A user interface 46 through which the user can provide inputs to control the extraction cleaner 10, including the systems or components thereof, is provided on the cleaner 10. As described in further detail below, the user interface 46 accept inputs to control the supply of power from a power source of the extraction cleaner 10 to one or more electrical components of the extraction cleaner 10. The power source of the extraction cleaner 10 can, for example, comprise a power cord 48 or a battery onboard the extraction cleaner 10. The user interface 46 is shown herein as provided adjacent the carry handle 42. Other configurations for the user interface 46 are possible.

Various other components and combinations of components can be incorporated into the fluid delivery system 14, such as pumps, valves, and/or fluid control features, as well as suitable conduits or tubing fluidly connecting the components of the fluid delivery system 14 together to effect the supply of cleaning fluid from the supply tank 18 to the distributors 20, 24.

Referring to FIG. 3, in one embodiment, the fluid delivery system 14 includes a flow control system for controlling the flow of fluid from the supply tank 18 to the distributors 20, 24. In one configuration, the flow control system can comprise a liquid supply pump 50 which pressurizes a liquid dispensing path 52 of the system 14 and controls the delivery of cleaning fluid to the liquid distributor 20, and a steam supply pump 54 which pressurizes a steam dispensing path 56 of the system 14 and controls the delivery of steam to the steam distributor 24. The pumps 50, 54 can be a solenoid pump, a centrifugal pump, or the like. While separate pumps 50, 54 are illustrated for supplying fluid to the distributors 20, 24, respectively, it is within the scope of the present disclosure for a single, split, or multi-stage pump to be utilized to supply fluid to the distributors 20, 24.

In some embodiments, the liquid pump 50 delivers cleaning fluid at a higher flow rate than the steam pump 54. In one non-limiting example, the liquid to steam flow rate ratio is about 4:1 to about 30:1, alternatively about 10:1. In another non-limiting example, the liquid pump 50 delivers cleaning liquid at a flow rate of about 300-1000 mL/min, alternatively about 400 mL/min, measured at the liquid distributor 20 and the steam pump 54 delivers steam at a flow rate of about 30-100 mL/min, alternatively about 40 mL/min, measured at the steam distributor 24. In other embodiments, the pumps 50, 54 can have multiple speeds and/or flow rates so that a flow rate of cleaning fluid out of the distributors 20, 24 can be varied.

The paths 52, 56 can include one or more ducts, tubing, hoses, etc. fluidly coupling the components of the fluid delivery system 14 together. As shown in FIG. 3, portions of the suction conduit 33, the liquid dispensing path 52, and the steam dispensing path 56 can be defined by the hose 32 and the tool 22. For example, the paths 52, 56 can include separate liquid and steam conduits 252, 254 routed through the hose 32, such as inside the suction conduit 33 used for extraction. In another embodiment, one or both of the liquid and steam conduits 252, 254 can be routed along an exterior of the suction conduit 33. In yet another embodiment, a portion of one or both of the liquid and steam conduits 252, 254 can be routed through the hose 32 and a portion of one or both of the liquid and steam conduits 252, 254 can be routed along an exterior of the suction conduit 33. Suitable air, liquid, and steam connectors can be provided at either end of the hose 32 for connection with the fluid supply and recovery components of the main housing 12 and the tool 22, as described in further detail below.

The dispensing of cleaning fluid may be controlled by the user at the tool 22. For example, the extraction cleaner 10 can include dispensing valves 58, 60 that control the flow of cleaning fluid through the distributors, respectively to the distributors 20, 24, with the distributors 20, 24 configured to distribute cleaning fluid upon opening of the dispensing valves 58, 60. Aside from this function, the dispensing valves 58, are not particularly limited, and may comprise any components and/or configurations suitable for use in/as a dispensing valve. The dispensing valves 58, 60 can, for example, be disposed on the wand 260 or the tool head 256 of the hand-held cleaning tool 22, and may be associated with appropriate user controls for operating the valves 58, 60.

A check valve 62 is provided in the fluid path between the supply tank 18 and the heater 26, and provides unidirectional flow of fluid through the path 56, i.e., preventing backflow into the tank 18. When present, the check valve 62 is configured for unidirectional flow into or through the heater 26 (e.g. in one direction from the tank 18 to the heater 26). Aside from this function, the check valve 62 is not particularly limited, and may comprise any components and/or configurations suitable for use in/as a check valve. In some aspects, when present, the check valve 62 may inhibit forward flow of liquid from the supply tank 18 in the event of negative pressure in the fluid path 56 as the heater 26 cools. This may inhibit and/or minimize creepage of liquid from the supply tank 18 through the path 56 when the heater 26 is de-activated after use and/or when the heater 26 is activated but the user is not dispensing steam. The creepage of liquid from the supply tank 18 after de-activation of the heater 26 may result in liquid remaining in the path 56 such that the next time the user activated the cleaner 10 in a mode that includes steam, this liquid remaining in the path 56 from the previous use would be dispensed in front of the steam, which may be undesirable to the user.

The check valve 62 can, for example be provided in the fluid path downstream of the pump 54 and upstream of the heater 26. In another embodiment, the check valve 62 can be provided in the fluid path downstream of the supply tank 18 and upstream of the pump 54.

A first or positive pressure relief device 64 in the fluid path between the supply tank 18 and the hose 32 controls or limits the pressure in the fluid delivery system 14. The first pressure relief device 64 opens at a predetermined set positive pressure to protect the fluid delivery system 14 from being subjected to high pressures that exceed their design criteria. When the set pressure is met or exceeded, the pressure relief device 64 diverts cleaning fluid through a bypass line 66 to the recovery tank 30. Aside from this function, the pressure relief device 64 is not particularly limited, and may comprise any components and/or configurations suitable for use in/as a pressure relief. In one embodiment, the pressure relief device 64 is a spring valve that opens at a predetermined set pressure.

During steam generation, pressure will build in the fluid delivery system 14 unless the pressure is released. Pressure is released, for example, by dispensing steam from the steam distributor 24. When there is blockage in the steam dispensing path 56 or the steam valve 60 otherwise remains closed for a period of time, when the heater 26 is activated, pressure will build in the in the fluid delivery system 14 as liquid is heated and steam is generated. When the pressure in the fluid delivery system 14 reaches the set pressure, the pressure relief device 64 opens, and cleaning fluid circulates back to the recovery tank 30 via the bypass line 66, allowing pressure to vent via the recovery system 16. Once pressure in the fluid delivery system 14 drops below the set pressure, such as may occur if steam is released from the path 56 or if the cleaner 10 is powered off, the pressure relief device 64 closes. The recovery tank 30 is fluidly coupled with the airflow generated by the vacuum motor 36 such that the recovery tank 30 vents to atmosphere by way of the vacuum motor exhaust when the vacuum motor 36 is powered off.

The set pressure may be, for example, about 10 PSI, about 11 PSI, about 12 PSI, about 13 PSI, about 14 PSI, or about 15 PSI, although it is understood that the set pressure may vary depending on the design limits of the portable extraction cleaner 10. In some embodiments, the first pressure relief device 64 can be configured to begin opening when a first predetermined set pressure is reached and then fully open when a second predetermined set pressure, greater than the first, is reached. For example, the first pressure relief device 64 can be configured to begin to open when the pressure reaches about 10 PSI and fully open when the pressure reaches about 15 PSI.

In some embodiments, an optional second or negative pressure relief device 65 is provided in the steam dispensing path 56. The second pressure relief device 65 can be configured to open to the ambient environment at a predetermined set negative pressure. Aside from this function, the pressure relief device 65 is not particularly limited, and may comprise any components and/or configurations suitable for use in/as a pressure relief. In one embodiment, the second pressure relief device 65 is a spring valve that opens at a predetermined set pressure.

As the heater 26 cools (such as when the cleaner 10 is powered off or the user selects a mode that does not include steam), a negative pressure may be generated in the steam dispensing path 56. The system may attempt to equalize this pressure by drawing liquid from the tank 18 into the steam dispensing path 56. This may result in liquid remaining in the steam dispensing path 56 during storage or in between use conditions. This liquid remaining in the steam dispensing path 56 may then be dispensed the next time the user opens the valve 60, which may be surprising and undesirable. In addition, liquid remaining in the steam dispensing path 56 during long storage periods may not be desirable. The second pressure relief device 65 can be configured to open to atmosphere at a predetermined set negative pressure, e.g., −1 PSI, to prevent or minimize the amount of liquid drawn into the steam dispensing path 56 from the tank 18 during cooling of the heater 26. Once pressure in the steam dispensing path 56 rises above the set negative pressure, the pressure relief device 65 closes.

Figure 4:
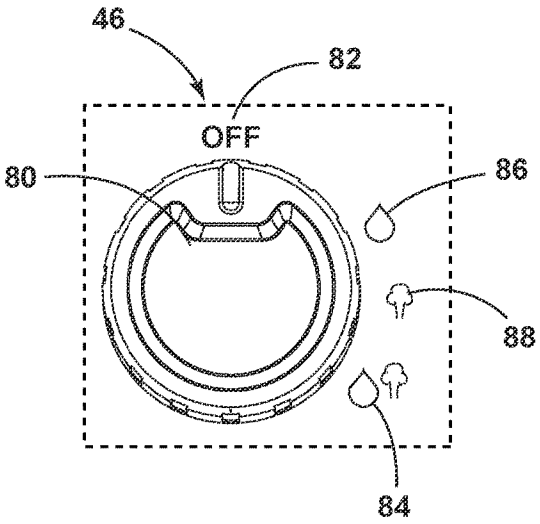
FIG. 4 is a top view of a user interface of the portable extraction cleaner.

FIG. 4 is a top view of one embodiment of the user interface 46. The user interface 46 can include a rotary dial selector 80 that can be rotated by a user between multiple positions to select a cleaning mode and to turn the extraction cleaner off. The extraction cleaner 10 can have, for example, a liquid/steam cleaning mode, a liquid cleaning mode, and a steam cleaning mode. Each position has an icon 82, 84, 86, 88 in the form of a graphic, symbol, word, or a combination thereof that gives the user an indication of the cleaning mode corresponding to that position of the dial selector 80. For example, the position corresponding to turning the extraction cleaner off has an icon 82 in the form of the word "OFF", the position corresponding to the liquid/steam cleaning mode has an icon 84 in the form of a graphic depicting a drop of liquid and steam, the position corresponding to the liquid cleaning mode has an icon 86 in the form of a graphic depicting a drop of liquid, and the position corresponding to the steam cleaning mode has an icon 88 in the form of a graphic depicting steam. In FIG. 4, the dial selector 80 is in the "OFF" position and points to icon 82. To turn the extraction cleaner 10 on and select a desired cleaning mode, a user can turn the dial selector 80 until it points to the icon 84, 86, 88 associated with the desired cleaning mode. Other embodiments for the user interface 46 are possible, including, but not limited to, a user interface having individual buttons or switches that allow a user to select a particular cleaning mode, optionally with a separate power switch.

The user interface 46 can optionally have one or more visual status indicators such as lights (e.g., LEDs), icon displays, textual displays, graphical displays, or the like, or any combination thereof. The user interface 46 can optionally have an auditory output component, such as a speaker.

The cleaning modes can have associated operating parameters for the heater 26, vacuum motor 36, liquid pump 50, and/or steam pump 54 (FIG. 3). The power cord 48 provides power to the electrical components of the extraction cleaner 10 from a source of power, such as a home power supply, upon turning the dial 80 to a selected cleaning mode. In all cleaning modes, the release of cleaning fluid can be controlled at the tool 22 or hose 32. In some aspects, the vacuum motor 36 is activated in each of the selectable cleaning modes and remains activated in each cleaning mode regardless of whether or not cleaning fluid is being dispensed.

Table 1 below lists some non-limiting examples of operating parameters for the cleaning modes, including whether the heater 26, vacuum motor 36, liquid pump 50, and steam pump 54 are on or off. Other operating parameters for the cleaning modes and other cleaning modes are possible.

TABLE 1

| Cleaning Mode | Vacuum Motor | Liquid Pump | Steam Pump | Heater |
|---|---|---|---|---|
| Liquid/Steam | ON | ON | ON | ON |
| Liquid | ON | ON | OFF | OFF |
| Steam | ON | OFF | ON | ON |

Figure 5:
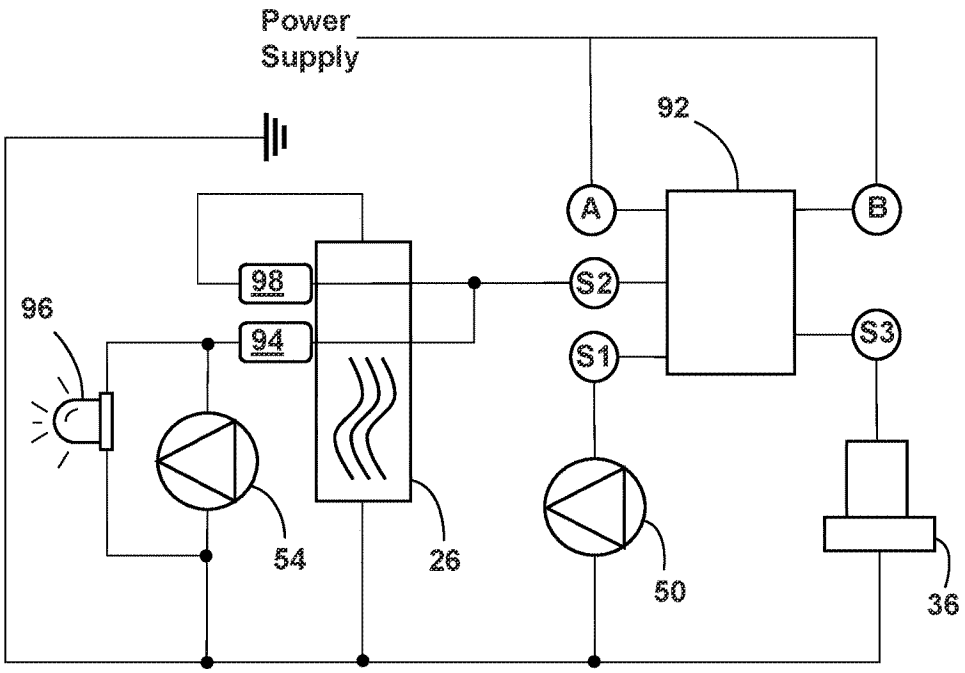
FIG. 5 is an electrical system schematic for the portable extraction cleaner.

FIG. 5 is an electrical system schematic for the portable extraction cleaner 10. A single multi-position rotary switch 92 can provide different actuation states for multiple circuits S1, S2, S3 for controlling operation of the heater 26, vacuum motor 36, liquid pump 50, and steam pump 54. The rotary switch 92 can, for example, comprise a 4-position rotary switch 92 controlled by the dial selector 80 (FIG. 4). The switches S1, S2, S3 are connected to connectors A, B which provide input signals indicative of the activation state of circuits S1, S2, S3 in order to provide four modes of operation utilizing the three circuits S1, S2, S3. The liquid pump 50 is activated by circuit S1, the heater 26 and steam pump 54 are activated by circuit S2, and the vacuum motor 36 is activated by circuit S3.

Table 2 provides a list of the mode selection possibilities of the 4-position rotary switch 92 with circuits S1, S2, S3 in the different activation states.

TABLE 2

| Switch Position | S1 | S2 | S3 |
|---|---|---|---|
| OFF | 0 | 0 | 0 |
| Liquid/Steam | 1 | 1 | 1 |
| Liquid | 1 | 0 | 1 |
| Steam | 0 | 1 | 1 |

When the extraction cleaner 10 turns on, e.g. by a user rotating the dial selector 80 (FIG. 4) until it points to the icon 84, 86, 88 of the desired cleaning mode, the vacuum motor 36 is activated by circuit S3. The liquid pump 50 is not activated until one of the cleaning modes with liquid delivery is selected. In other words, circuit S1 turns the liquid pump 50 on in the liquid/steam cleaning mode and in the liquid cleaning mode. The heater 26 is not activated until one of the cleaning modes with steam is selected. In other words, the circuit S2 turns the heater 26 on in the liquid/steam cleaning mode and in the steam cleaning mode.

In addition to the second circuit S2, power to the steam pump 54 is controlled by a first temperature switch 94 that controls when the steam pump 54 energizes to limit any unheated water from coming out of the tool 22 at the beginning of operation. The temperature switch 94 senses temperature at the heater 26 and turns the steam pump 54 on at a predetermined minimum temperature. The minimum temperature can correspond to a minimum temperature at which steam is produced by the heater 26. When the minimum temperature is met or exceeded, the temperature switch 94 powers the steam pump 54 to pressurize the steam dispensing path 56 and deliver steam to the tool 22. Aside from this function, the temperature switch 94 is not particularly limited, and may comprise any components and/or configurations suitable for use in/as a temperature switch. In one embodiment, the temperature switch 94 is a normally-open (NO) thermostat on the heater 26. When the minimum temperature is met or exceeded, the thermostat closes and powers the steam pump 54.

The minimum temperature may be, for example, 165° C., although it is understood that the minimum temperature may vary depending on the design limits of the portable extraction cleaner 10 and the desired characteristics of the dispensed steam. The minimum temperature may be set based on an expected minimum operating temperature for the heater 26 that will produce steam with a desired stream quality.

The extraction cleaner 10 can include an indicator light 96 to indicate to the user when steam is ready and available for dispensing. This indicator light 96 can be energized by the first temperature switch 94. The indicator light 96 can comprise at least one light source behind a transparent or translucent cover, and may be located on the main housing 12, such as on the partition 40 and/or on the user interface 46, or on the tool 22. The light can comprise any element or assembly capable of emitting light, and can, for example, a light emitting diode (LED) as shown herein. Other lights include incandescent lamps, e.g. halogen, arc lamps, and gas-discharge lamps, e.g. fluorescent.

A second temperature switch 98 cuts off power to the heater 26 at a predetermined maximum temperature to control or limit the temperature of the heater 26. The temperature switch 98 senses temperature at the heater 26 and cuts off power to the heater 26 at a predetermined maximum temperature. The maximum temperature can be a temperature at which the heater 26 may operate within the design limits of the surrounding components of the extraction cleaner 10, and may also be a threshold above which heater 26 need not operated to produce a desired steam output for effective cleaning. When the maximum temperature is met or exceeded, the temperature switch 98 cuts off power to the heater 26 to allow the heater 26 to cool. Once the temperature of the heater 26 drops below the maximum temperature, the temperature switch 98 supplies power to the heater 26 and the heater 26 is energized. Aside from this function, the temperature switch 98 is not particularly limited, and may comprise any components and/or configurations suitable for use in/as a temperature switch. In one embodiment, the temperature switch 98 is a normally-closed (NC) thermostat on the heater 26. When the maximum temperature is met or exceeded, the thermostat opens and cuts off power to the heater 26. When the temperature of the heater 26 drops below the maximum temperature, the thermostat closes and the heater 26 is energized.

The predetermined maximum temperature may be, for example, 180° C., although it is understood that the maximum temperature may vary depending on the design limits of the portable extraction cleaner 10 and the desired characteristics of the dispensed steam.

Figure 7:
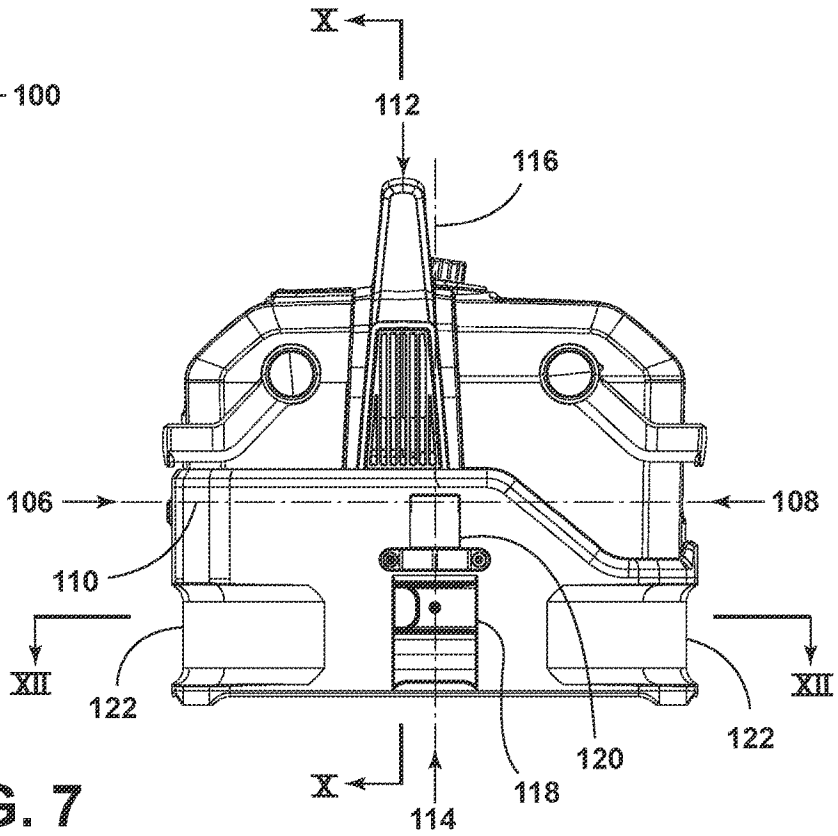
FIG. 7 is a front view of the portable extraction cleaner, with the hose assembly not shown for clarity.
Figure 6:
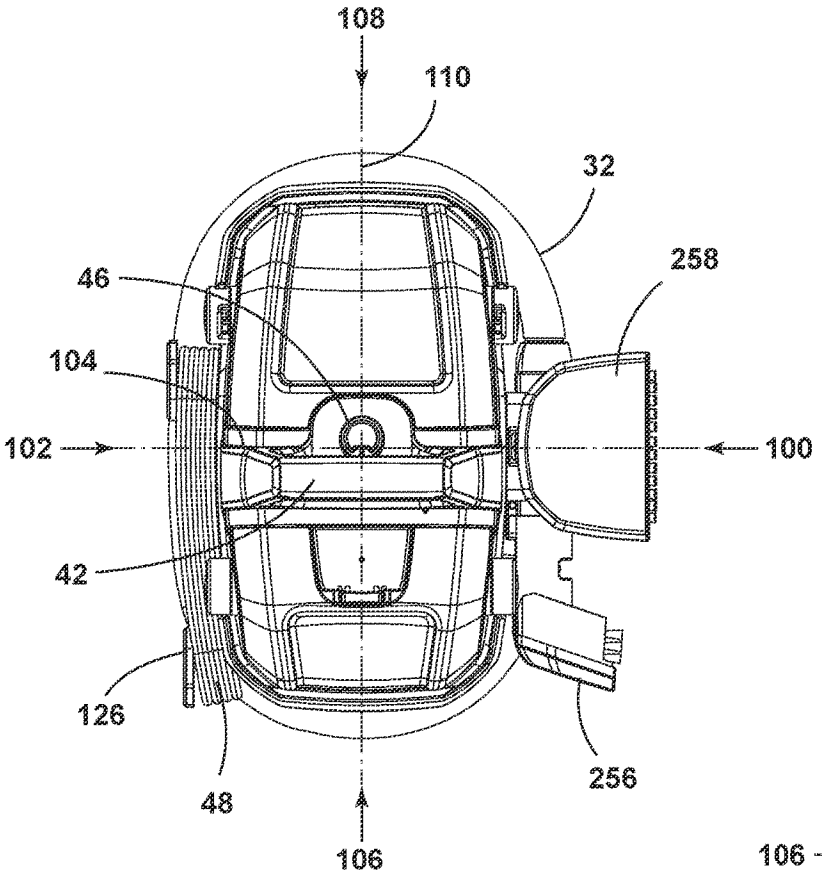
FIG. 6 is a top view of the portable extraction cleaner.

Referring to FIG. 6-7, the portable extraction cleaner 10 has a front side 100, a rear side 102 opposite the front side 100, a first horizontal longitudinal axis 104 from the front side 100 to the rear side 102, two opposite lateral sides 106 and 108 disposed between the front side 100 and the rear side 102, and a second horizontal longitudinal axis 110 from the first lateral side 106 to the second lateral side 108. The extraction cleaner 10 further has a top side 112, a bottom side 114 opposite the top side 112, a vertical axis 116 from the top side 112 to the bottom side 114. The sides 100, 102, 106, 108, 112, and 114 may, in some embodiments, be defined by the main housing or pod 12.

The base 38 can comprise a housing with a flat bottom that defines the bottom side 114 and is adapted to rest directly on a surface, such as a horizontal surface or floor surface. While not shown in FIG. 6-7, in some embodiments, the base 38 can comprise wheels on the bottom side 114 for increased maneuverability of the main housing 12, and the wheels are adapted to support the base 38 on the surface.

Conveniently, the user interface 46 can be provided at the top side 112, opposite the flat bottom side 114 so that a user can easily access the user interface 46 whether the extraction cleaner 10 is being carried or resting on a surface.

The supply tank 18 is arranged at the first lateral side 106 and the recovery tank 30 is arranged at the second lateral side 108. The partition 40 between the tanks 18, 30 may be offset with respect to the first axis 104, e.g. may be disposed closer to one lateral side than the other lateral side. In the embodiment shown, the partition 40 is closer to the first lateral side 106. This may, for example, accommodate a larger volume recovery tank 30 on the second lateral side 108.

Conveniently, the carry handle 42 can be provided at and extend from the top side 112, opposite the flat bottom side 114 so that a user can easily pick up the extraction cleaner 10. The carry handle 42 may be offset with respect to the first axis 104, e.g. may be disposed closer to one lateral side than the other lateral side. In the embodiment shown, the carry handle 42 is closer to the first lateral side 106, and is disposed on the offset partition 40.

The extraction cleaner 10 can include one or more tool holders 118, 120 which store the cleaning tool 22 and optional interchangeable tool head 258, respectively, and a hose wrap 122 on the base 38 to support the hose 32 wrapped around the base 38 for storage (see FIGS. 1 and 6). The hose 32 can couple with a hose coupler 124 on the base 38. By way of non-limiting example, the tool holders 118, 120 can be on the front side 100 and the hose coupler 124 can be on the rear side 102, and the hose 32 may wrap at least once, and optionally more than once, around the base 38 to store the connected tool 22 on the tool holder 118. For clarity, the tool 22, tool head 258, and hose 32 are not shown in FIG. 7.

The extraction cleaner 10 can include a cord wrap 126 for the power cord 48 on the rear side 102. In a cordless embodiment where the extraction cleaner 10 has a battery, the cord wrap and power cord are not provided. In such an embodiment, a battery or battery pack can be provided on the main housing 12, and may optionally be removable from the main housing 12.

Figure 8:
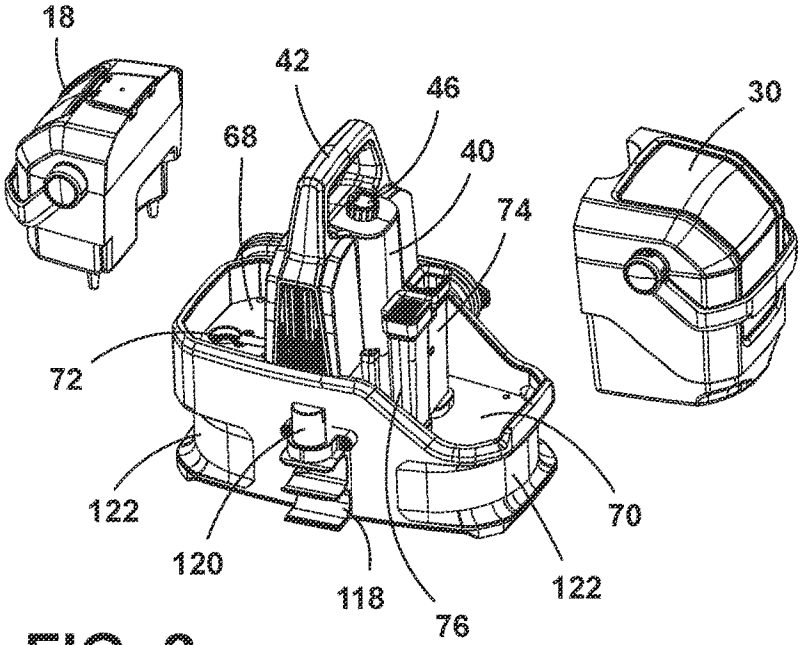
FIG. 8 is a perspective view of the portable extraction cleaner, with the hose assembly not shown for clarity, and a supply tank and a recovery tank shown exploded from the main housing.

Referring to FIG. 8, the main housing 12 can include tank receivers 68, 70 that respectively receive the tanks 18, 30. In one embodiment, the main housing 12 is configured to removably support the tanks 18, 30 in an upward orientation in which the tanks 18, 30 at least partially defines the top side 112 of the extraction cleaner 10. The supply tank receiver 68 includes a cleaning fluid receiver assembly 72 in the base 38 to fluidly couple the supply tank 18 with the pumps 50, 54. The recovery tank receiver 70 includes an intake duct 74 and an exhaust duct 76 to fluidly couple the recovery tank 30 with the recovery path 33. Tank latches (not shown) may selectively secure the tanks 18, 30 to the main housing 12.

Figure 9:
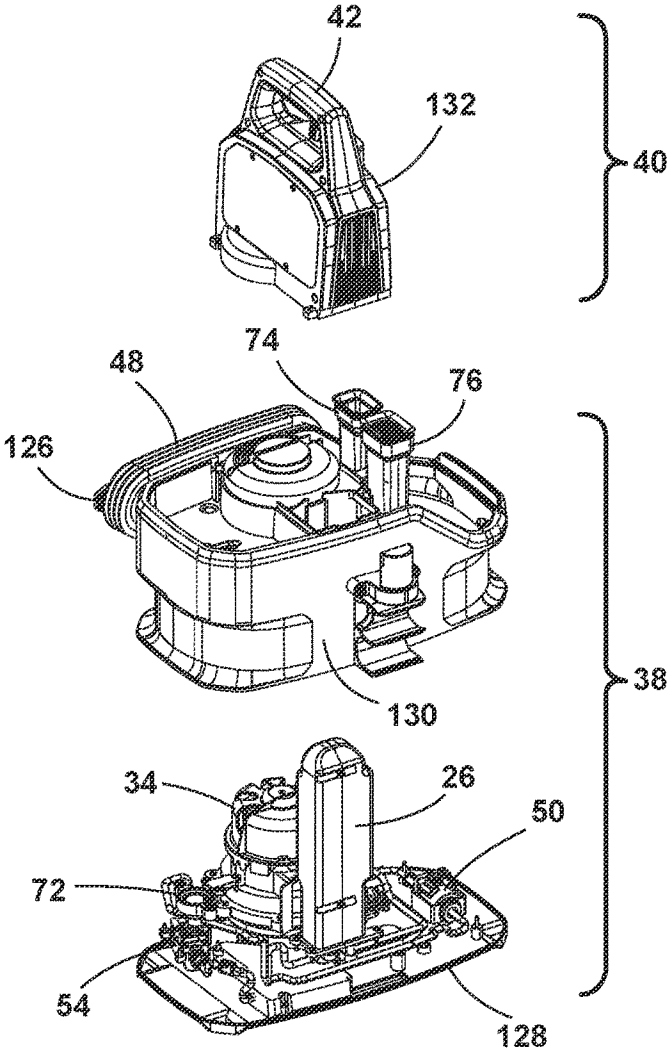
FIG. 9 is a partially-exploded view of the main housing of the extraction cleaner.

Referring to FIG. 9, various electrical components of the extraction cleaner 10 can be mounted in the base 38 and/or partition 40 of the main housing 12. The base 38 may include a lower base portion 128 coupled to an upper base portion 130. The lower base portion 128 and the upper base portion 130 may be separate components releasably or permanently attached together using fasteners (e.g., screws, bolts, tabs, detents, hooks, etc.). Alternatively, the upper base portion 130 may be integrally formed with the lower base portion 128, or the upper base portion 128 and the lower base portion 130 may be formed together as a unitary body. The lower base portion 128 includes the flat bottom side 114 of the extraction cleaner 10. The upper base portion 128 can define at least portion of the front, rear, and lateral sides 100, 102, 106, 108 of the extraction cleaner 10.

The partition 40 can include a partition housing 132 coupled to the upper base portion 130. The partition housing 132 and the upper base portion 130 may be separate components releasably or permanently attached together using fasteners (e.g., screws, bolts, tabs, detents, hooks, etc.). Alternatively, the partition housing 132 may be integrally formed with the upper base portion 130, or the partition housing 132 and the upper base portion 130 may be formed together as a unitary body. The partition housing 132 can define at least portion of the front, rear, and top sides 100, 102, 112 of the extraction cleaner 10.

Figure 10:
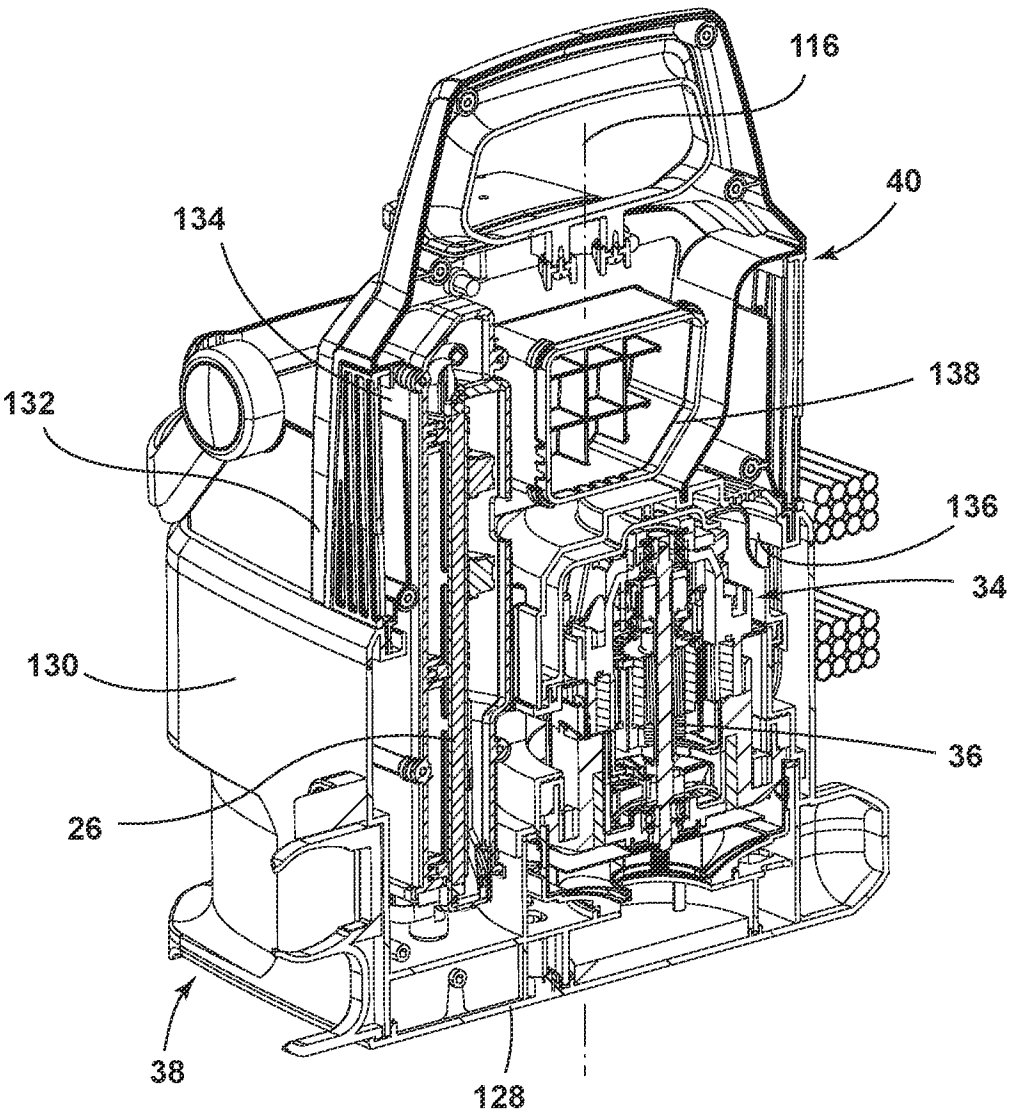
FIG. 10 is a cross-section view of the portable extraction cleaner, taken through line X-X of FIG. 7.

Referring to FIGS. 8-10, physically larger components such as the suction source 34 and heater 26 utilize the vertical space available in the area of the partition 40. For example, the heater 26 can be disposed in a heater cavity 134 on the main housing 12. The heater cavity 134 is disposed between the tanks 18, 30 and can be formed in the partition 40 or, as shown herein, partially in the base 38 and partially in the partition 40. By way of non-limiting example, the heater cavity 134 can be formed by molded features of the upper base portion 130 and partition housing 132.

The suction source 34 can be disposed in a motor cavity 136 on the main housing 12. The motor cavity 136 is disposed between the tanks 18, 30 and can be formed in the partition 40 or, as shown herein, partially in the base 38 and partially in the partition 40. By way of non-limiting example, the motor cavity 136 can be formed by molded features of the upper base portion 130 and partition housing 132. A wire enclosure 138 encloses various wiring (not shown) of the extraction cleaner 10, including, but not limited to, wiring for the heater 26 and the vacuum motor 36, and may be located above the suction source 34 and to the side of the heater 26.

To accommodate the suction source 34 and heater 26 within the partition 40, the suction source 34 and heater 26 can be spaced apart relative to the second horizontal axis 110. For example, the heater 26 can be disposed on one side of the axis 110 and at least a majority of the bulk of the suction source 34 can be disposed on an opposing side of the axis 110. In some aspects, the second horizontal axis 110 may define a vertical plane extending between the tanks 18, 30 with the heater 26 disposed on one side of the vertical plane and at least a majority of the bulk of the suction source 34 disposed on the opposite side of the vertical plane.

The base 38 can include an exhaust vent 240 defining an air outlet for working air exhaust from the suction source 34. The exhaust vent 240 be formed in the lower base portion 128 or in another portion of the base 38.

Figure 11A:
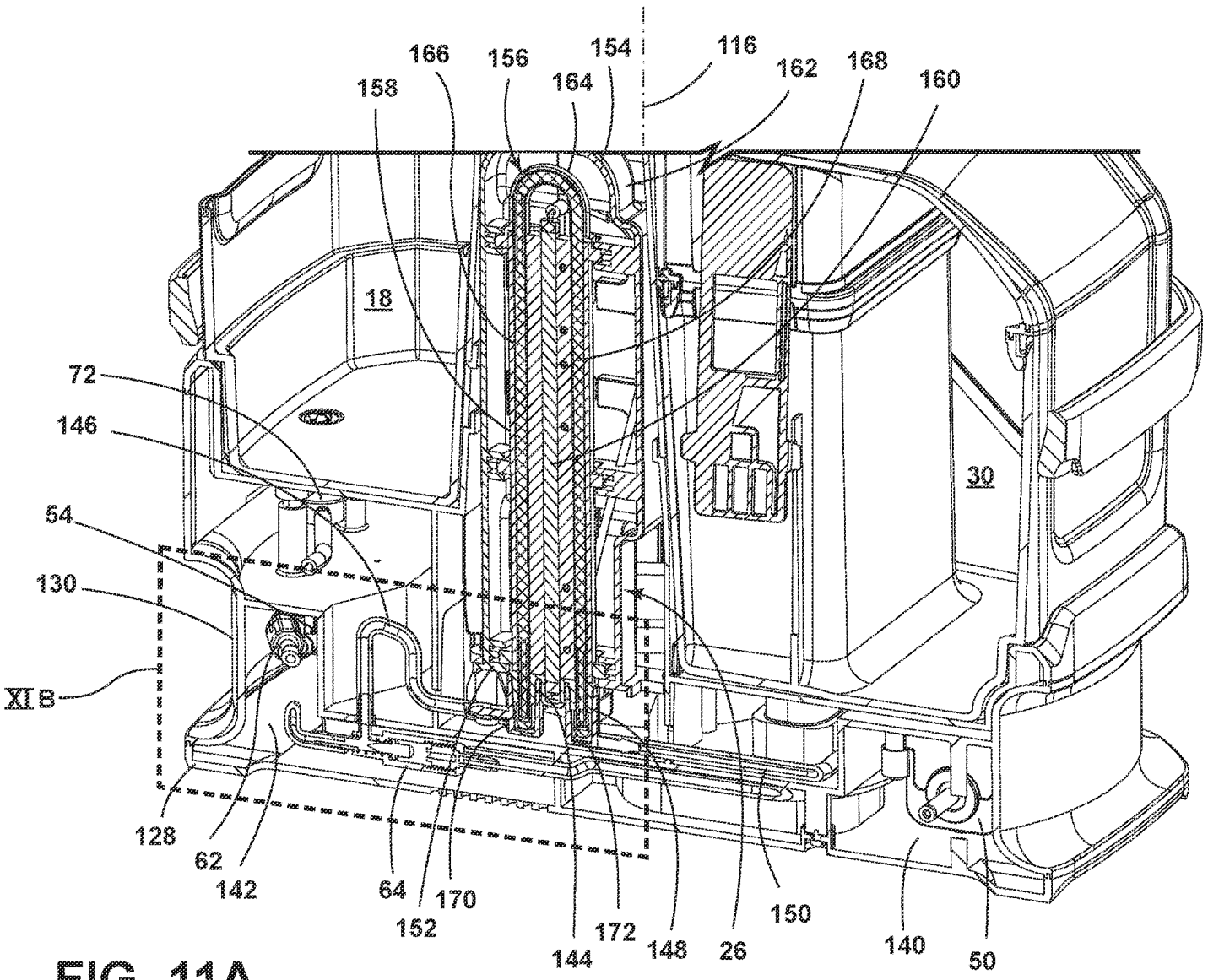
FIG. 11A is a cross-section view of the portable extraction cleaner, taken through line XIA-XIA of FIG. 2.
Figure 11B:
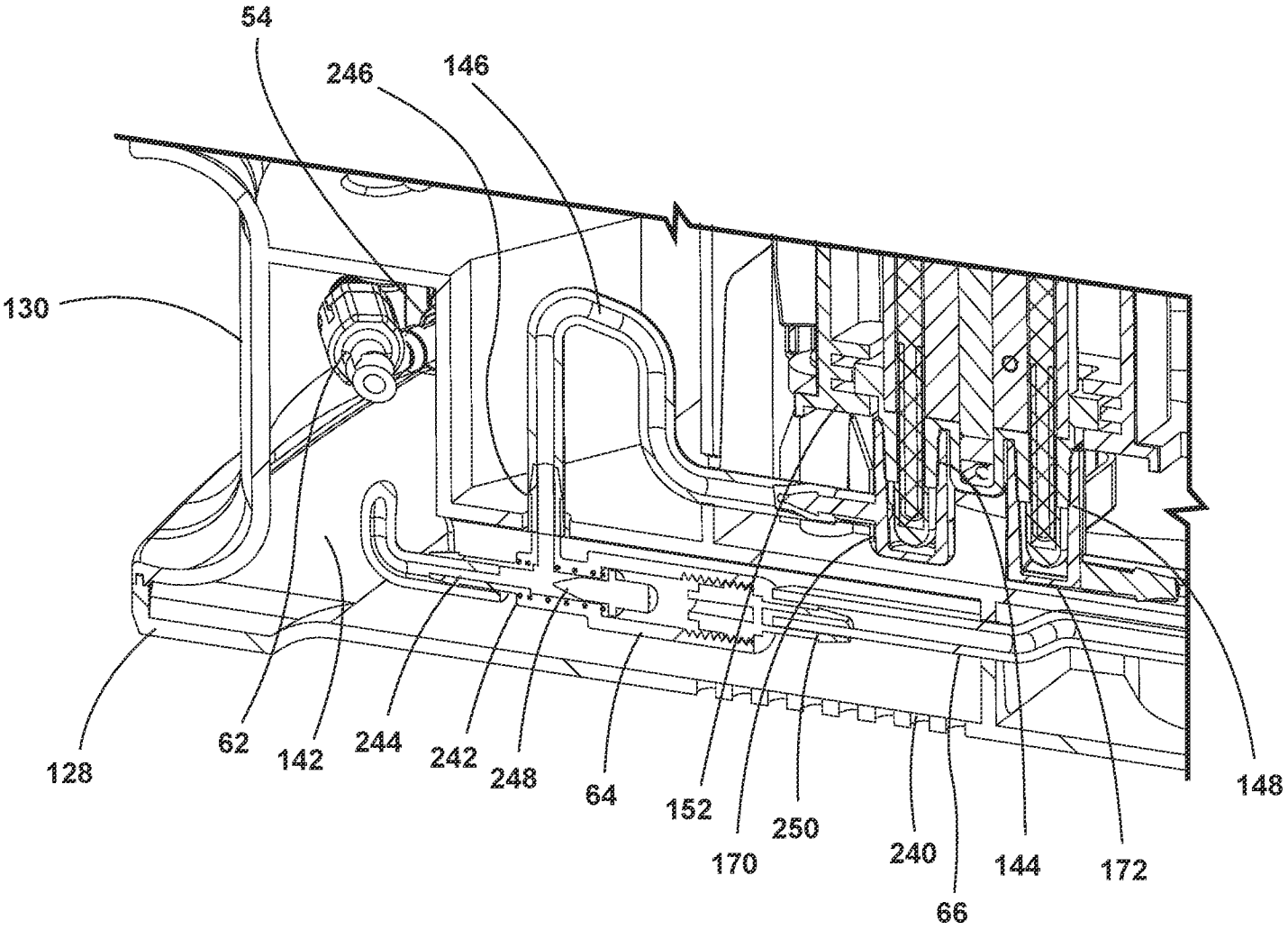
FIG. 11B is a close-up view of section XIB of FIG. 11A.
Figure 12:
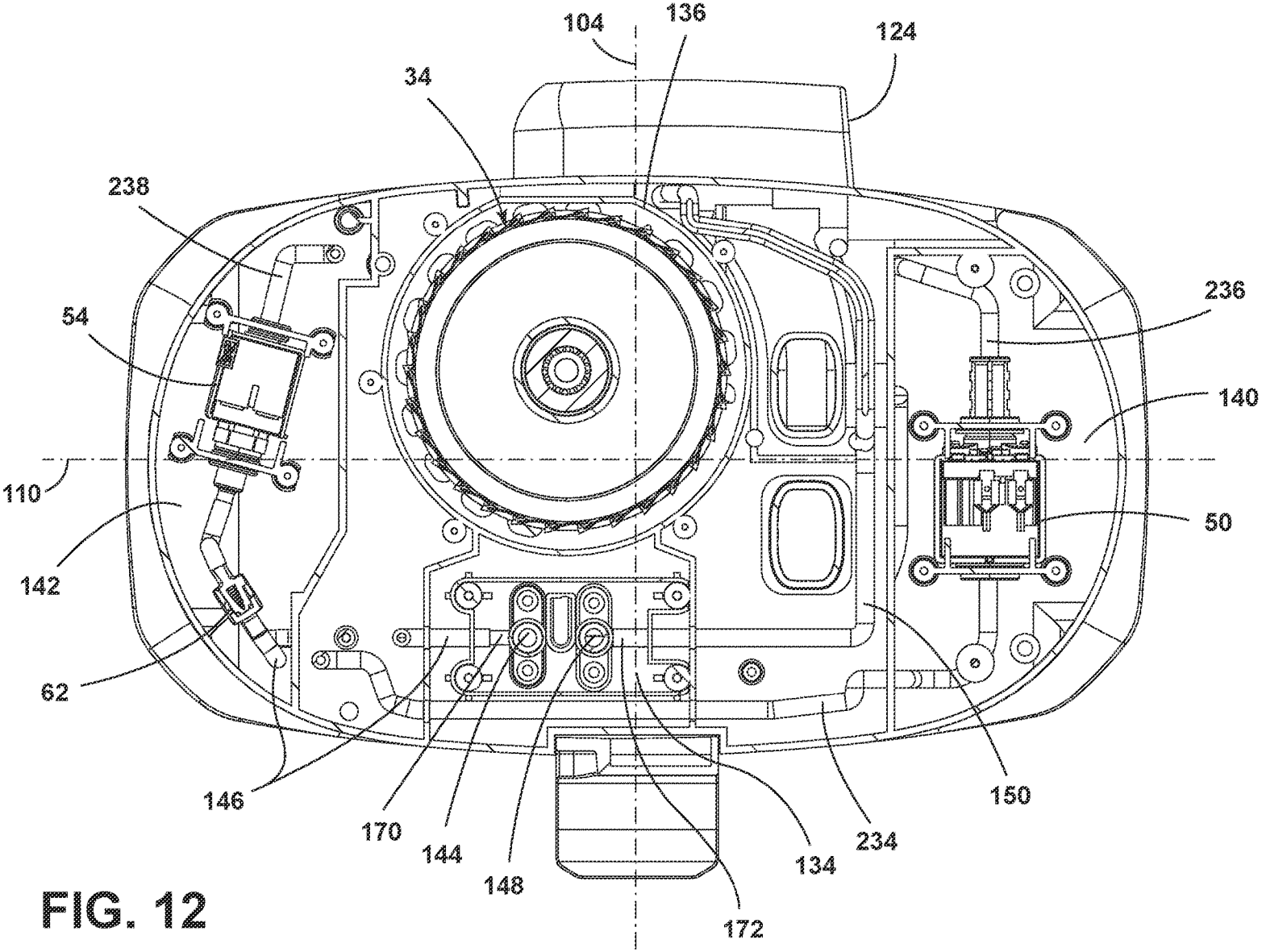
FIG. 12 is a cross-section view of the portable extraction cleaner, taken through line XII-XII of FIG. 7.

Referring to FIGS. 11-12, physically smaller components such as the pumps 50, 54 can utilize the space available in the base 38, including the space below the tanks 18, 30 and/or the partition 40. To accommodate multiple pumps 50, 54 and their associated fluid conduits, the pumps 50, 54 can be arranged on opposing sides of the vertical axis 116. For example, the steam pump 54 can be disposed below the supply tank 18 and the liquid pump 50 can be disposed below the recovery tank 30. Other relative orientations are possible, including, but not limited to a configuration where the liquid pump 50 is disposed below the supply tank 18 and the steam pump 54 is disposed below the recovery tank 30.

The pumps 50, 54 can be disposed in separate pump cavities 140, 142 on the main housing 12. By way of non-limiting example, the pump cavities 140, 142 can be formed by molded features of the lower base portion 128 and the upper base portion 130.

The liquid pump 50 includes a pump inlet fluidly connected to the supply tank 18, for example, via a pump inlet conduit 234, and a pump outlet fluidly connected to the hose coupler 124 by a liquid supply conduit 236. The steam pump 54 includes a pump inlet fluidly connected to the supply tank 18, for example, via a pump inlet conduit 238, and a pump outlet fluidly connected to the heater 26 by a steam pump outlet conduit 146. In one embodiment, the inlet conduits 234, 238 for each pump 50, 54 are coupled with the cleaning fluid receiver assembly 72 (FIG. 8).

Other smaller components such as the check valve 62 and the pressure relief device 64 can also utilize the space available in the base 38, including the space below the tanks 18, 30 and/or the partition 40. As shown in FIGS. 11A-12, the check valve 62 may be disposed below the supply tank 18 and may optionally be located within the same cavity 142 as the steam pump 54.

The pressure relief device 64 may be disposed below the supply tank 18 and/or the heater 26. By way of non-limiting example, the pressure relief device 64 is a spring valve disposed between the lower base portion 128 and the upper base portion 130. The pressure relief device 64 includes a valve body 242 having a valve inlet 244 in fluid communication with the steam pump 54 and a valve outlet 246 in fluid communication with the heater 26. A spring-biased plunger 248 normally closes a bypass outlet 250 connected to the bypass line 66, which is fluidly coupled with the recovery tank 30 as described in further detail below. When the set pressure for the pressure relief device 64 is reached, the plunger 248 opens, and cleaning fluid passes through the bypass outlet 250 to circulate back to the recovery tank 30 via the bypass line 66, allowing pressure to vent.

FIGS. 10-11B show details related to the heater 26, according to one aspect of the disclosure. The heater 26 includes a heater inlet 144 fluidly connected to the supply tank 18, for example via the steam pump 54 and/or valve, via pump outlet conduit 146, and a heater outlet 148 fluidly connected to the hose coupler 124 by a second or steam supply conduit 150.

The heater 26 can be vertically oriented, with the inlet 144 and outlet 148 at a lower end 152 of the heater 26, which can maximize liquid dwell time within the heater 26. For example, by pumping liquid through the heater 26 initially in an upward direction, e.g., against gravity, dwell time increases. The heater inlet and outlet 144, 148 can accordingly be disposed at a lower end of the heater cavity 134.

In being vertically oriented, the lower end 152 of the heater is below an upper end 154 of the heater 26, and the heater 26 may deviate up to 5 degrees from vertical, up to 10 degrees from vertical, up to 20 degrees from vertical, or up to 45 degrees from vertical, and be considered vertically oriented for the purposes of the description herein. In one aspect, the heater 26 is oriented at an angle of ±10 degrees from vertical.

The heater 26 includes a fluid-conducting tube 156 encased in a body 158 with an electric heating element 160. The tube 156 can be constructed of stainless steel or other suitable material and the body 158 can be constructed of aluminum or other suitable thermally conductive material. The tube 156, body 158, and heating element 160 can be enclosed within a heater box 162. The heater box 162 is shown herein as including two halves; other configurations for the heater box 162 are possible.

The heating element 160 uniformly heats the cleaning fluid as it passes through the tube 156. The heating element 160 may, for example, be selected to effectively deliver around 650 watts to around 1000 watts of power to heat the cleaning fluid in the tube 156 to a temperature of around 100±10° C., alternately about 90 to 100° C., alternatively about 95 to 98° C., and produce steam having a steam quality of 100% or less, alternatively about 70% to 100%.

The tube 156 can have a single 180 degree bend 164 between the inlet 144 and the outlet 148, the bend 164 generally dividing the tube 156 into two tube portions 166, 168. The tube portions 166, 168 may be substantially parallel to each other and to the vertical axis 116 of the extraction cleaner 10. In being substantially parallel, the tube portions 166, 168 can deviate up to 5 degrees from the axis 116, up to 10 degrees from the axis 116, or up to 20 degrees from the axis 116. With the heater inlet and outlet 144, 148 at the lower end 152 of the heater 26, the bend 164 in the tube 156 can accordingly be disposed at the upper end 154 of the heater 26.

The heating element 160 can be disposed between the two tube portions 166, 168 and below the bend 164 to transmit heat to both tube portions 166, 168. At least a majority of the tube portions 166, 168 are surrounded by the thermally conductive body 158. The bend 164, inlet 144, and/or outlet 148, including any combination thereof, may extend outside the thermally conductive body 158.

According to one aspect of the disclosure, the base 38 can be divided into 3 component zones arranged along the second horizontal axis 110. With reference to FIGS. 7, 8, and 12, the first zone includes a seat configured to receive the tank 18 and a space below the tank seat for one of the water pump 50 or the steam pump 54. The second, central zone includes the heater 26 and the suction source 34. Adjacent to the second zone is the third zone of the base 38, which includes a seat configured to receive the recovery tank 30 and space below the tank seat for the other of the water pump 50 or the steam pump 54 (whichever pump is not disposed within the first zone). In addition, the second zone is configured to couple with the partition 40. This also allows for the carry handle 42 to generally be aligned with the base zone containing the heaviest components of the extraction cleaner 10 (e.g., the suction source 34). The relative location of the tanks 18, 30, pumps 50, 54, heater 26, and suction source 34 within the first, second, and third zones of the base 38 may contribute to fitting this combination of components within a base 38 having a desirable footprint that is not too large, in addition to distributing the weight of the components as desired. In some aspects, within the second, central zone, the second horizontal axis 110 may define a vertical plane through the first, second, and third zones with the heater 26 disposed on one side of the vertical plane and at least a majority of the bulk of the suction source 34 disposed on the opposite side of the vertical plane. Positioning the heater 26 within the second zone, which is coupled with the partition 40, provides vertical space to accommodate the heater 26 at a desired vertical orientation and having a desired fluid path length between the heater inlet 144 and the heater outlet 148.

In one embodiment, the heater inlet 144 can comprise an inlet fitting 170 fluidly connected to an inlet end of the tube 156 and the heater outlet 148 can comprise an outlet fitting 172 fluidly connected to an outlet end of the tube 156. The inlet fitting 170 can be fluidly connected to the conduit 146 to conduct pressurized liquid from the steam pump 54 to the tube 156. The outlet fitting 172 can be fluidly connected to steam supply conduit 150 to conduct steam from the tube 156 to hose coupler 124.

In some embodiments, the pump outlet conduit 146 can include and/or be defined by the check valve 62 and the pressure relief device 64. For example the pump outlet conduit 146 can include tubing connected between the steam pump 54 and the check valve 62, tubing connected between the check valve 62 and the valve inlet 244, tubing connected between the valve outlet 246 and the heater inlet fitting 170, and the passage within the valve body 242 between the valve inlet 244 and valve outlet 246.

Figure 14:
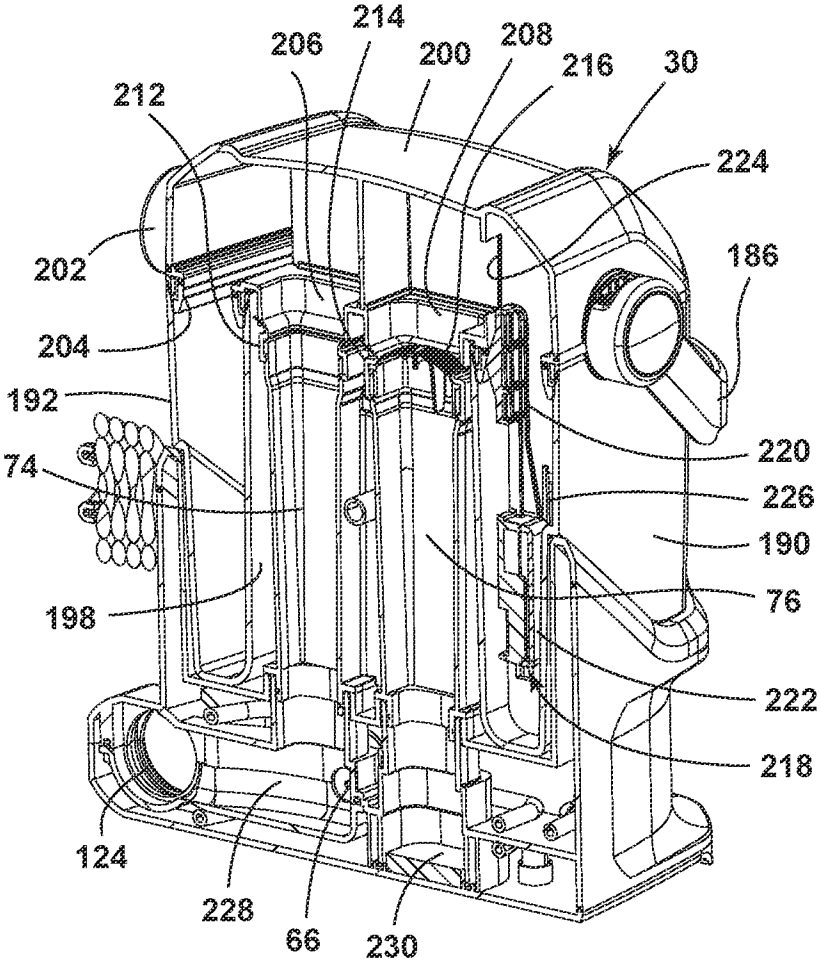
FIG. 14 is a cross-section view of the portable extraction cleaner, taken through line XIV-XIV of FIG. 2.
Figure 13:
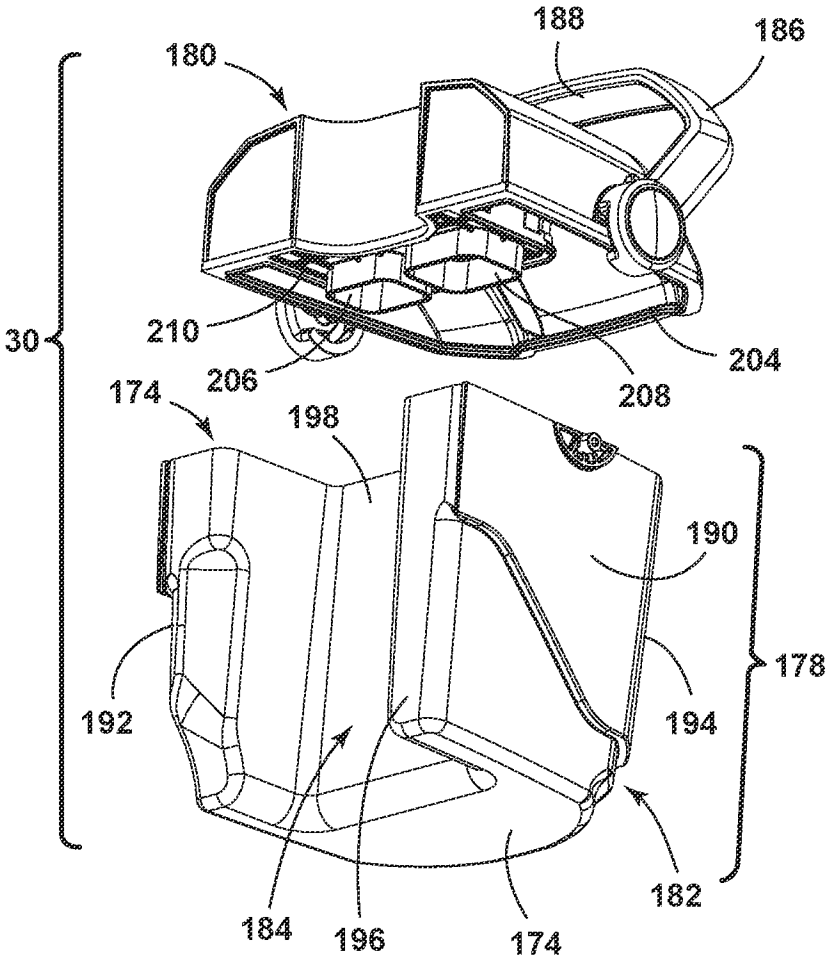
FIG. 13 is a partially-exploded view of the recovery tank.

With reference to FIGS. 13-14, the recovery tank 30 comprises a container 174 that defines an internal volume for receiving and storing recovered liquid and dirt drawn up from the surface being cleaned by the suction airflow generated by the suction source 34. The container 174 can be formed of a transparent or tinted translucent material, which permits a user to view the contents thereof.

The illustrated container 174 includes a bottom wall 176 and a side wall 178 defining an open top, with a lid 180 closing the open top. The side wall 178 can include multiple walls, including one or more walls forming an externally-facing surface 182 when the tank 30 is seated in the receiver 70, and one or more walls forming an internally-facing surface 184 that is internal to the extraction cleaner 10 when the tank 30 is seated in the receiver 70. The externally-facing surface 182 forms an external surface of the extraction cleaner 10. The bottom wall 176 rests on a planar surface of the tank receiver 70 when the tank 30 is seated in the receiver 70 and can be flat or otherwise shaped to support the tank 30 in an upward orientation on a horizontal surface or floor surface when the tank 30 is separated from the main housing 12.

A U-shaped handle 186 is pivotally attached to opposing sides of the container 174. The handle 186 is of sufficient size so that a space is formed between a gripping area 188 of the handle 186 and a top surface of lid 180 when the handle 186 is in an upright position. Furthermore, the handle 186 is shaped so that the gripping area of the handle 186 lies along side wall 178 of the container 174 when the handle 13 is rotated to a horizontal position (see, for example, FIG. 14).

In one embodiment, the handle 186 can include a latch to secure the lid 180 on the container 174. When the handle 13 is rotated to the horizontal position, the lid 180 is unlatched and can be removed from the container 174. When the handle 186 is in the upright position, such as when carrying the tank 30 by the handle 186, the lid 180 is latched to the container 174.

By way of non-limiting example, the externally-facing surface 182 can be formed by a front wall 190 and a rear wall 192 connected by a side wall 194, and the internally-facing surface 184 can be formed by a second side wall 196 that includes a recessed section 198. The walls 190-196 are formed integrally with the bottom wall 176 to close the bottom end of the container 174. The tank lid 180 covering the container 174 is arranged at the open end of the container 174 opposite the closed end.

The tank lid 180 may be removably coupled to the open end of the container 174 to provide access to the internal volume of the container 174 for emptying and cleaning the container 174. For example, the tank lid 180 may include a lid cover 200 having a lower portion or skirt 202 configured to be received on the container 174, and may include a seal 204 to provide a sealing engagement with the container 174. The handle 186 may be attached to the skirt 202, such that the handle 186 can be used to remove the lid 180 from the container 174. In this arrangement, the tank lid 180 is axially insertable onto and axially removable from the container 174. In an alternative embodiment, the tank lid 180 may be hingedly connected to the container 174 or screwed onto the container 174.

The recovery tank 30 includes an intake port 206 and an exhaust port 208. When the tank 30 is seated on the tank receiver 70, as shown in FIG. 14, the intake port 206 couples with the intake duct 74 and the exhaust port 208 couples with the exhaust duct 76. The ducts 74, 76 are therefore outside the container 174.

The ports of the tank 30 can be disposed in the lid 180. The lid 180 may include a frame 210 coupled to the cover 200, and the ports 206, 208 can be formed in the frame 210. The frame 210 can, in one embodiment, support the ports 206, 208 below the cover 200 and/or within a boundary of the lid 180 defined by the skirt 202.

The frame 210 and the cover 200 may be separate components releasably or permanently attached together using fasteners (e.g., screws, bolts, tabs, detents, hooks, etc.). Alternatively, the frame 210 may be integrally formed with the lid cover 200, or the frame 210 and cover 200 may be formed together as a unitary body. The seal 204 may be disposed around the lower edges of the frame 210.

In one embodiment, the ports 206, 208 are open to the space defined by the recessed section 198 of the container 174. When the tank 30 is seated on the tank receiver 70, as shown in FIG. 14, the ducts 74, 76 nest within the recessed section 198.

The intake duct 74 guides air and liquid in an upward direction and into the recovery tank 30 via the intake port 206. The exhaust duct 76 guides "clean" working air to the suction source 34 via the exhaust port 208. Seals 212, 214 may provide a fluid-tight interface between the ducts 74, 76 and the ports 206, 208. The exhaust duct 76 can include a screen 216 at an upper end thereof to prevent large debris from entering the exhaust duct 76.

The recovery tank 30 can include a float 218 for selectively closing the extraction path through the recovery tank 30. The float 218 can include a float shutter 220 and a float body 222 provided on the float shutter 220 for selectively raising the float shutter 220 to a closed position in which the float shutter 220 closes an entrance into the exhaust duct 76. For example, the floor shutter 220 can close a side entrance opening 224 into the exhaust port 208, the side entrance opening 224 defining an air exit from the container 174. In an alternate embodiment, the shutter 220 can close the port 208. The float 218 slides within a float bracket 226 within the container 174. As the liquid level in the recovery tank 30 rises, the float 218 rises and eventually closes the entrance opening 224 to prevent liquid from entering the suction source 34 of the extraction cleaner 10.

A hose inlet duct 228 extends from the hose coupler 124 to the intake duct 74, and fluidly communicates the hose 32 with recovery tank 30. A motor inlet duct 230 extends from the exhaust duct 76 to the suction source 34, and fluidly communicates the recovery tank 30 with the suction source 34. The hose inlet duct 228 and motor inlet duct 230 thereby form a portion of the recovery system and recovery pathway. By way of non-limiting example, the ducts 228, 230 can extend within the base 38, such as within or between the lower and upper base housings 128, 130.

In one embodiment, the bypass line 66 from the pressure relief device 64 (FIG. 11) can couple with the hose inlet duct 228, upstream of an entrance into the intake duct 74. As such, any cleaning fluid diverted through the bypass line 66 joins the recovery pathway upstream of the recovery tank 30 and can be collected within the recovery tank 30. In another embodiment, the bypass line 66 can couple with the intake duct 74 or with a portion of the recovery tank 30.

Figure 15:
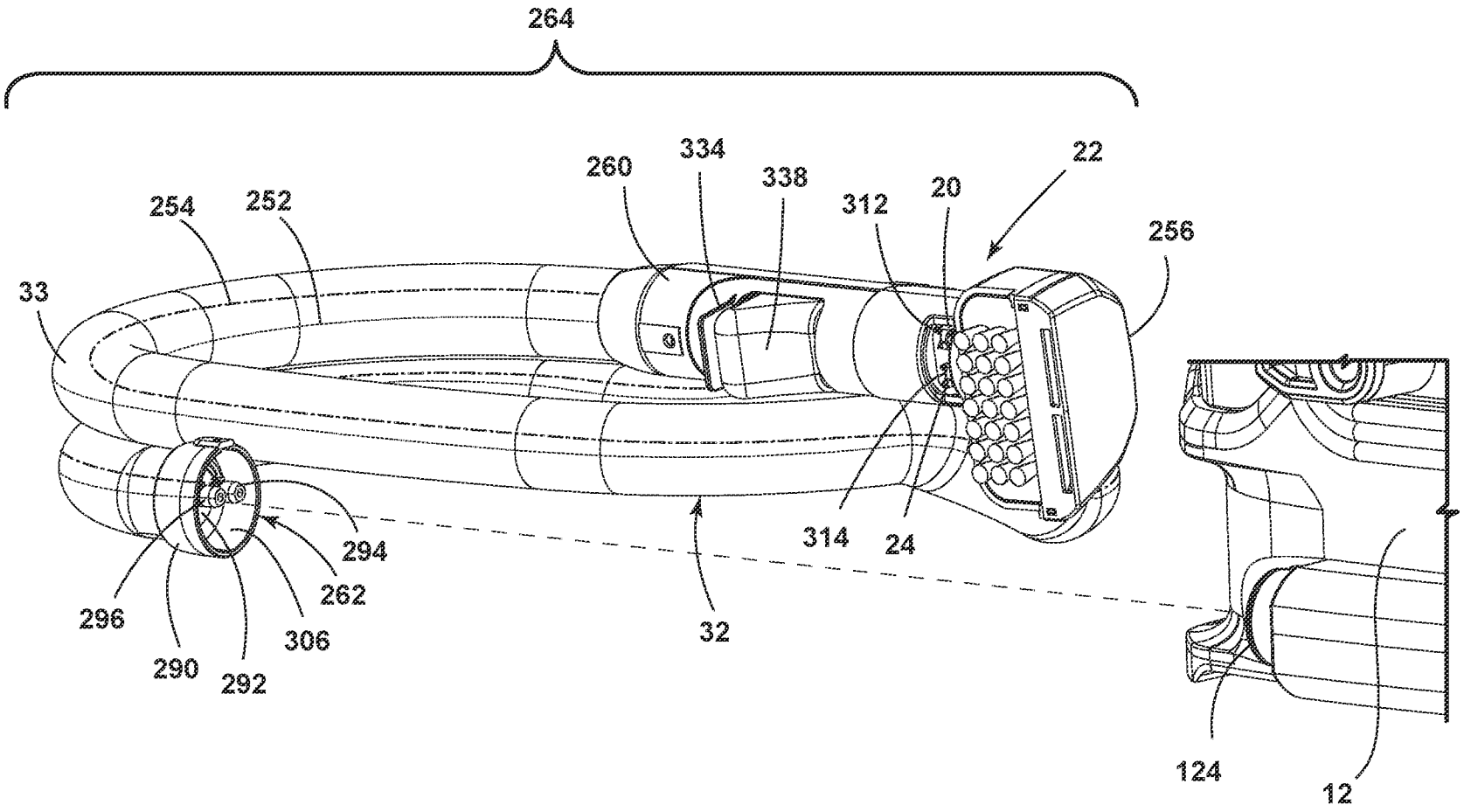
FIG. 15 is a perspective view showing the hose assembly exploded from a hose coupler on the main housing.

FIG. 15 is a view showing the hose 32 disconnected from the main housing 12. The wand 260 connects the tool head 256 to a distal end of the hose 32, and a hose adaptor 262 at a proximal end of the hose 32 connects the hose 32, including the suction conduit 33, liquid conduit 252, and steam conduit 254, to the hose coupler 124 on the main housing 12. In one embodiment, the hose 32, the wand 260, and the hose adaptor 262 forms a removable hose assembly 264, with the wand 260 interchangeably receiving one of multiple tool heads, for example tool head 256 or tool head 258 (FIG. 1), and the hose adaptor 262 removably connecting to the hose coupler 124 on the main housing 12. In the embodiment shown, the hose liquid and steam conduits 252, 254 are routed inside the suction conduit 33 used for extraction, and are represented in dashed line in FIG. 15.

The hose adaptor 262 can have a quick connect coupling with the hose coupler 124 to quickly and simply connect the hose 32 with the pod 12 to establish a continuous flow path therebetween. The hose assembly 264 can thereby be quickly connected to the pod 12 by hand, without the use of a tool. Disconnection the hose assembly 264 can also be performed by hand.

Figure 16:
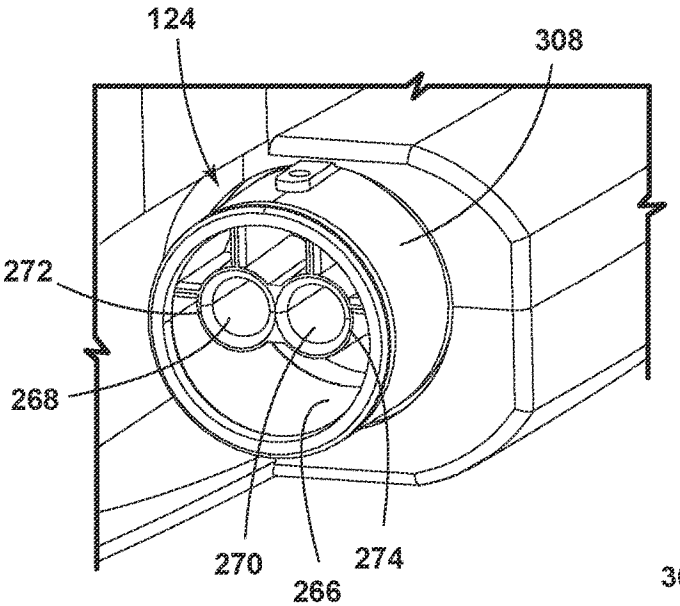
FIG. 16 is a close-up view of the hose coupler on the main housing.

FIG. 16 is a close-up view showing the hose coupler 124. The hose coupler 124 includes a suction passage 266 in fluid communication with the hose inlet duct 228 (FIG. 17), a liquid passage 268 for the passage of liquid out of the pod 12, and a steam passage 270 for the passage of steam out of the pod 12. The passages 268, 270 can comprise female receivers 272, 274, respectively at an outlet or hose side of the hose coupler 124.

Figure 17:
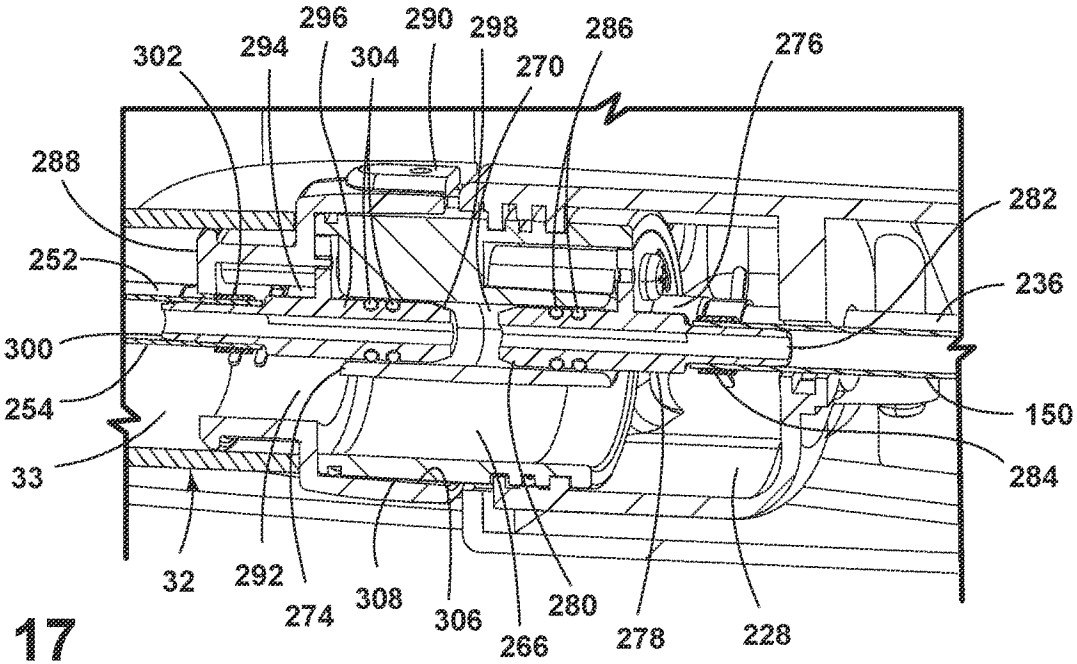
FIG. 17 is a close-up, cross-section view of the portable extraction cleaner, taken through line XVII-XVII of FIG. 2.

Referring to FIG. 17, within the pod 12, the hose coupler 124 can have fittings 276, 278 to connect supply conduits 236, 150 to the passages 268, 270. The steam fitting 278 is shown in cross-section FIG. 17, and described herein, and it is understood that the liquid fitting 27 may have an identical or substantially identical structure. On one side, the steam fitting 278 can comprise a male connector 280 inserted axially into the steam passage 270. On the other side, the steam fitting 278 can have a barbed end 282 or other structure to receive and retain thereon the steam supply conduit 150. A clamp 284 may secure the supply conduit 150 on the barbed end 282 of the fitting 278. O-rings 286 or another sealing element can be provided at the interface between the fitting 278 and the passage 270 to prevent leakage of cleaning fluid at the interface. In illustrative embodiment, the O-rings 286 are carried on the male connector 280 of the fitting 278.

Referring to FIGS. 15 and 17, the hose adaptor 262 includes a hose side having a hose receiver 288 and a coupler side having a coupler receiver 290. A suction passage 292 extends through both sides of the hose adaptor 262 to fluidly couple the suction conduit 33 with the suction passage 266 of the hose coupler 124 to establish a continuous flow path therebetween. The hose adaptor 262 has a liquid fitting 294 and a steam fitting 296 for the passage of liquid and steam through the adaptor 262. The steam fitting 296 is shown in cross-section FIG. 17, and described herein, and it is understood that the liquid fitting 294 may have an identical or substantially identical structure. On one side, the steam fitting 296 can comprise a male connector 298 insertable axially into the female receiver 274 of the steam passage 270. On the other side, the steam fitting 296 can have a barbed end 300 or other structure to receive and retain thereon the hose steam conduit 254. A clamp 302 may secure the hose steam conduit 254 on the barbed end 300 of the fitting 296. O-rings 304 or another sealing element can be provided at the interface between the fitting 296 and the steam passage 270 to prevent leakage of cleaning fluid at the interface. In illustrative embodiment, the O-rings 304 are carried on the male connector 298 of the fitting 296.

The hose receiver 288 may have an outside diameter selected to fit within an inside diameter of the hose 32, and in some embodiments within an inside diameter of the suction conduit 33. The hose 32 may be inserted over the hose receiver 288 and held in place by friction or mechanical interference. Alternatively, the hose 32 may be over-molded, glued, or otherwise additionally secured on the hose receiver 288.

For quick connection of the hose adaptor 262 with the hose coupler 124, the coupler receiver 290 may have a circumferential surface 306 with an inside diameter selected to fit on an outside diameter of a circumferential surface 308 of the hose coupler 124. The coupler receiver 290 may be inserted over the hose coupler 124, and held in place by friction or mechanical interference, with the axial insertion of the adaptor fittings 294, 296 into the coupler passages 268, 270 providing additional friction or mechanical interference to maintain a secure connection. Alternatively, the quick connect coupling may include a latch, bayonet connection, or the like to secure the hose adaptor 262 to the hose coupler 124.

In the embodiment shown, at least some of the liquid- and steam-carrying components of the hose 32, the hose adaptor 262 and the hose coupler 124 are within the recovery pathway and are exposed to working air flowing from the suction conduit 33 into the hose inlet duct 228. In another embodiment, such liquid- and steam-carrying components may include at least portions that are outside the recovery pathway.

Referring to FIG. 15, in one embodiment, the wand 260 includes the liquid and steam distributors 20, 24. The wand 260 is adapted to receive the tool head 256, with the distributors 20, 24 in register with a dispensing window 310 on the tool head 256.

The distributors 20, 24 can comprise any structure, such as a nozzle, a spray tip, or a manifold, and can comprise one or multiple outlets for cleaning fluid. In one non-limiting example, the distributors 20, 24 are spray tips having outlets 312, 314 configured to distribute cleaning fluid through the dispensing window 310. In FIG. 15, the distributors 20, 24 are located on an underside of the wand 260, with the steam distributor 24 separate from and next to the liquid distributor 20.

Figure 18:
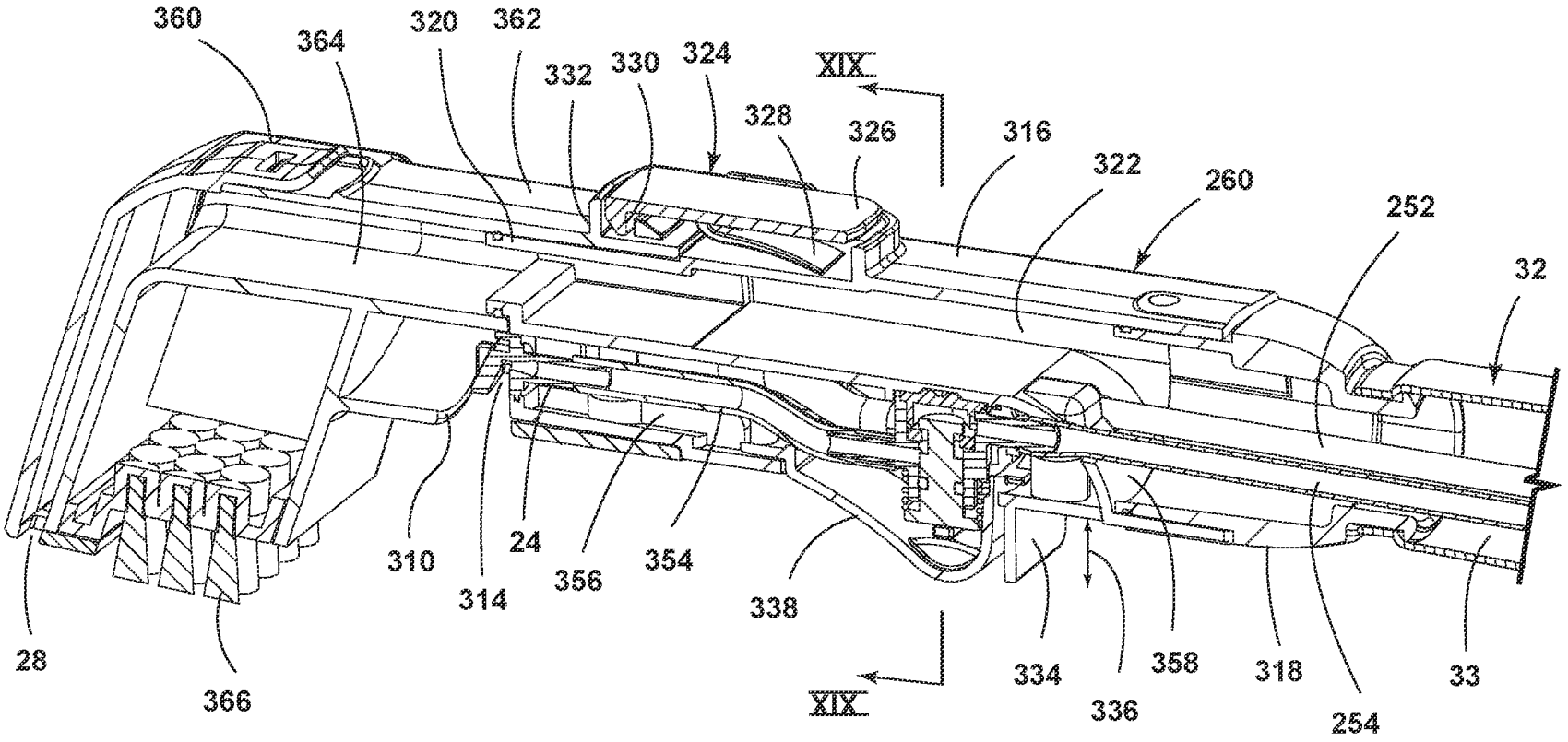
FIG. 18 is a cross-section view of a cleaning tool and hose of the portable extraction cleaner, taken through line XVIII-XVIII of FIG. 2, the cleaning tool including a wand and tool head.

Various configurations for the wand 260 are possible. Referring to FIG. 18, the wand 260 may include a wand body 316, a hose collar 318 at a proximal end of the wand body 316 and tool connector 320 at a distal end of the wand body 316. A suction passage 322 extends through the wand body 316, from the hose collar 318 to the tool connector 320.

The collar 318 may have outside dimensions selected to fit within the inside dimensions of the hose 32. Where the collar 318 is annular or ring-shaped, the collar 318 may have an outside diameter selected to fit within an inside diameter of the hose 32, and in some embodiments within an inside diameter of the suction conduit 33. The suction passage 322 is thereby in fluid communication with the suction conduit 33. The hose 32 may be inserted over the collar 318 and held in place by friction or mechanical interference. Alternatively, the hose 32 may be over-molded, glued, or otherwise additionally secured on the collar 318.

The liquid and steam distributors 20, 24, can be disposed at the distal end of the wand body 316. In one embodiment, the distributors 20, 24 are disposed on the tool connector 320.

To keep the distributors 20, 24 free of debris, the distributors 20, 24 can be disposed on an exterior side of the suction passage 322. In one embodiment, the suction passage 322 can extend through an interior of the tool connector 320, and the distributors 20, 24 can be disposed on an exterior side of the tool connector 320, below the suction passage 322.

A latch 324 releasably secures the tool head 256 on the wand 260, and can be carried on the tool head 256 or wand 260. In the embodiment shown herein, the latch 324 is carried on the wand 260 and includes an externally-accessible button 326 and a molded-in spring 328 biasing a latching end 330 of the latch 324 toward a latch receiver 332 on the tool head 256.

The wand 260 can include the valves 58, 60 controlling the flow of cleaning fluid to the distributors 20, 24, and at least one dispensing control operably connected to one of the valves 58, 60 to affect and control opening and closing of the valves 58, 60. Non-limiting examples of a dispensing control include a trigger, button, toggle, key, switch, or the like, or any combination thereof. The hose liquid and steam conduits 252, 254 extend through the collar 318 and into the wand body 316 to couple with inlets of the valves 58, 60.

In the embodiment shown, the release of cleaning fluid can be controlled by a trigger 338. The trigger 338 can operate both valves 58, 60, where depressing the trigger 338 opens both valves 58, 60. Release of the trigger 338 closes the valves 58, 60. In another embodiment, the trigger 338 and/or the valves 58, 60 can be located on the tool head 256.

The release of liquid and/or steam upon depression of the trigger 338 can be mode-dependent. In other words, depending on a selected cleaning mode of the extraction cleaner 10, depression of the trigger 338 may or may not release liquid to the liquid distributor 20 and may or may not release steam to the steam distributor 24. For example, depression of the trigger 338 in the liquid/steam cleaning mode releases liquid and steam, depression of the trigger 338 in the liquid cleaning mode releases liquid and does not release steam, and depression of the trigger 338 in the steam cleaning mode releases steam and does not release liquid. In some aspects, the vacuum motor remains actuated/on in each of the selectable cleaning modes, such that suction remains actuated both when the trigger 338 is depressed and also when it is not depressed. In yet another embodiment, a separate steam dispensing control (not shown) selectively operates the steam valve 60 to control steam dispensing, while the trigger 338 selectively operates the liquid valve 58 to control liquid dispensing. A user may operate both controls at the same time for simultaneous liquid and steam dispensing.

In some embodiments, the wand 260 can include a trigger guard 334 that allows the wand 260 to be rested on a surface without depressing the trigger 338. The trigger guard 334 can extend from the wand body 316 by a distance that is at least equal to, and alternatively a distance that is greater than, a normal projection distance 336 of the trigger 338 from the wand body 316.

Figure 19:
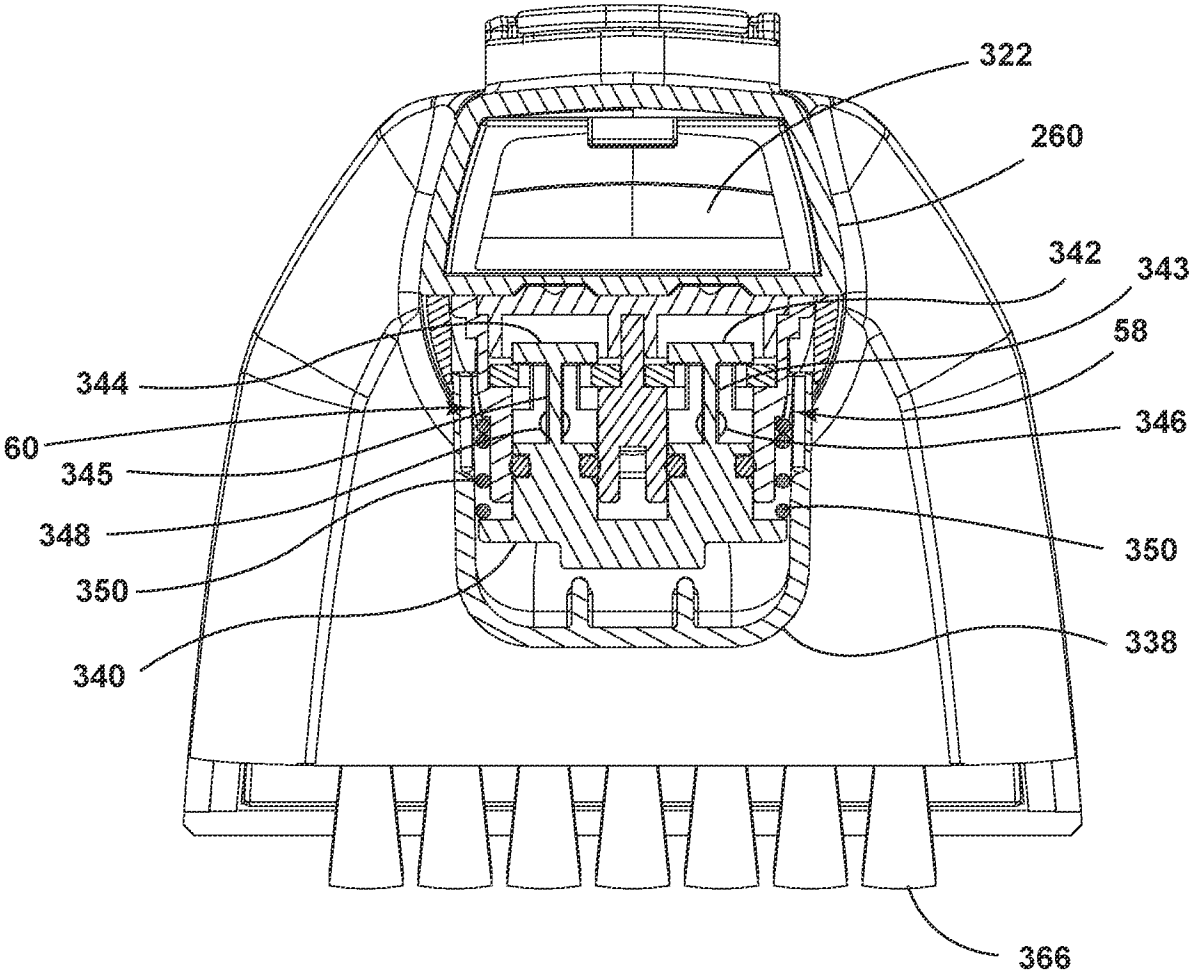
FIG. 19 is a cross-section view of the cleaning tool taken through line XIX-XIX of FIG. 18.

Referring to FIG. 19, in one embodiment, the trigger 338 operates a dual-stem valve body 340 coupled with a valve head 342 for the liquid valve 58 and a valve head 344 for the steam valve 60, where the valve heads 342, 344 can open or close parallel valve outlets 346, 348 to the distributors 20, 24. The trigger 338 and valve body 340 are biased outwardly from the wand 260 by at least one, and optionally more than one, spring 350 to a position where the valve heads 342, 344 block, plug, or otherwise close the valve outlets 346, 348 to the distributors 20, 24. The outwardly-biased position of the trigger 338 can define the normal projection distance 336 of the trigger 338.

In FIG. 19, the trigger 338 is undepressed and the valves 58, 60 are closed, with the valve heads 342, 344 closing the valve outlets 346, 348. Depression of the trigger 338 forces the valve body 340 to move, against the bias of the spring or springs 350, and the valve heads 342, 344 to unlock, unplug, or otherwise open the valve outlets 346, 348.

The dual-stem valve body 340 can include integrally-formed stems 343, 345, each supporting or coupled with one of the valve heads 342, 344, respectively such that the entire valve body 340 moves as one by depression of the trigger 338 or under the biasing force of the spring or springs 350.

The valve outlets 346, 348 can fluidly communicate directly with the distributors 20, 24 or indirectly via suitable conduits or tubing 352, 354 that extends through the wand body 316 in a cavity 356 that is fluidly isolated from the suction passage 322. The valves 58, 60 and trigger 338 may also be mounted in the cavity 356, with the hose liquid and steam conduits 252, 254 entering the cavity 356 through a rear wall 358.

Figure 20:
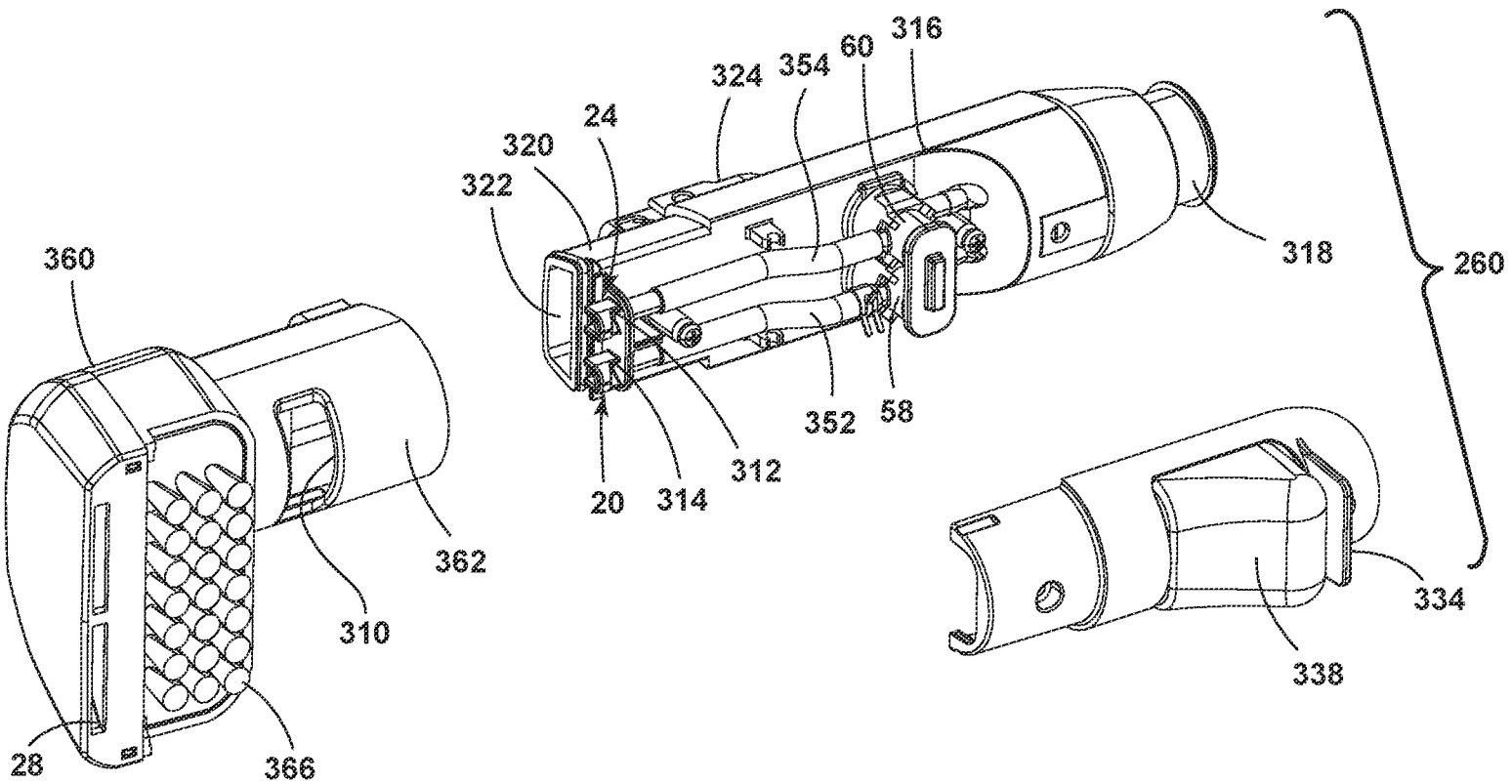
FIG. 20 is a partially-exploded view of the wand and tool head

Various configurations for the tool head 256 are possible. Referring to FIGS. 18 and 20, the tool head 256 may include a tool body 360 having the extraction nozzle 28 at a distal end of the tool body 360 and a wand connector 362 at a proximal end of the tool body 360. A suction passage 364 extends through the tool body 360, from the extraction nozzle 28 to the wand connector 362.

The wand connector 362 may include the dispensing window 310 on an underside of the tool body 360. The wand connector 362 may have inside dimensions selected to fit on the outside dimensions of the wand 260, and in some embodiments may have an inside dimensions selected to fit on the outside dimensions of the tool connector 320 of the wand 260. Where the wand connector 362 is annular or ring-shaped, the wand connector 362 may have an inside diameter selected to fit on an outside diameter of the wand 260, and in some embodiments may have an inside diameter selected to fit on an outside diameter of the tool connector 320 of the wand 260. The wand connector 362 may be inserted over the tool connector 320, with an overlap sufficient to align the distributors 20, 24 with the dispensing window 310, and held in place by the latch 324.

The wand connector 362 can include a sidewall defining the inside dimensions, and dispensing window 310 can be formed as an opening through the sidewall. The sidewall can be annular, or have another shape selected on the wand 260, and in some embodiments on the tool connector 320 of the wand 260.

A brush 366 can be provided on the tool head 256 for scrubbing the surface to be cleaned. As shown in the illustrated embodiment, the brush 366 can comprise a plurality of bristles. The bristles can be bundled together in tufts to provide the desired stiffness and durability for agitation. Other agitators for the tool head 256 are possible.

The dispensing window 310 may be located behind the extraction nozzle 28 and the brush 366, so that cleaning fluid dispensed from the distributors 20, 24 can be viewed by the user. For the steam dispensed from the steam distributor 24 this rearward spacing can ensure that the steam does not get suctioned into the extraction nozzle 28 before reaching the surface to be cleaned.

Other tools heads for the wand 260, such as tool head 258 (FIG. 1), may have compatible features for attachment on the wand 260, including having a dispensing window for the liquid and steam distributors 20, 24 and wand connector that can couple with the tool connector 320.

Figure 22:
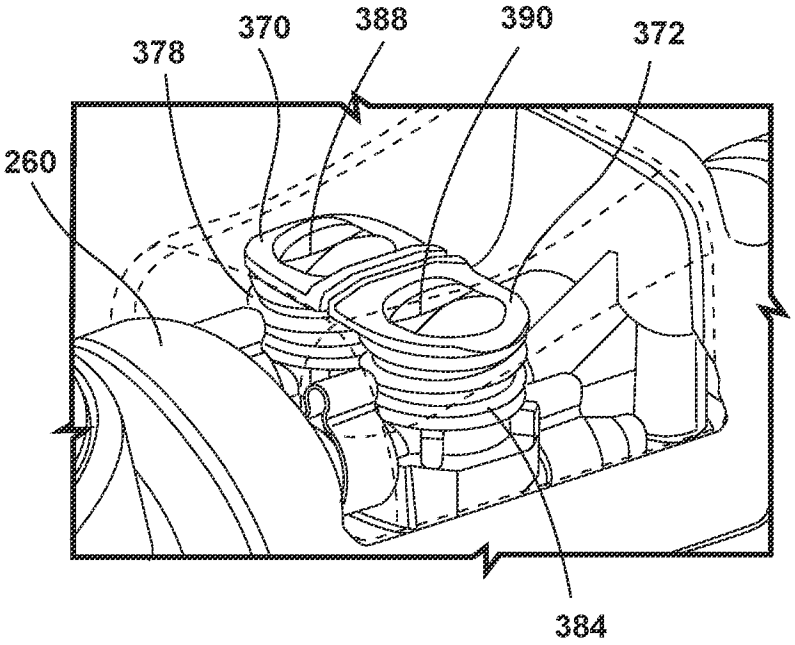
FIG. 22 is a bottom perspective view of the valve-actuator assembly of FIG. 21, with the trigger shown in phantom line for clarity.
Figure 21:
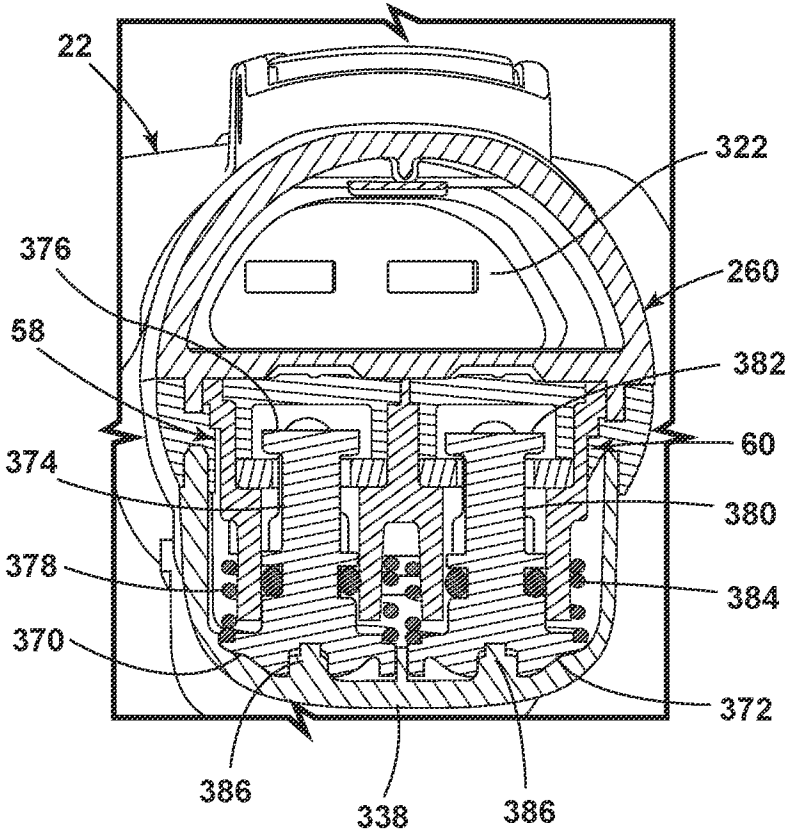
FIG. 21 is a cross-section view similar to FIG. 1, showing another embodiment of a trigger and valve-actuator assembly.

Referring to FIGS. 21-22, in an alternative embodiment, the trigger 338 operates individual valve bodies 370, 372 for the liquid valve 58 and steam valve 60, respectively. The trigger 338 may still operate both valves 58, 60, and may be operable under decreased force in comparison to the dual-stem configuration.

The liquid valve body 370 can include a valve stem 374 supporting or coupled with a valve head 376, and biased by a spring 378 to a position where the valve head 376 blocks, plugs, or otherwise closes the dispensing path 52 to the liquid distributor 20 (FIG. 3).

The steam valve body 372 can include a valve stem 380 supporting or coupled with a valve head 382, and biased by a spring 384 to a position where the valve head 382 blocks, plugs, or otherwise closes the dispensing path 56 to the steam distributor 24 (FIG. 3).

In FIG. 21, the trigger 338 is undepressed and the valves 58, 60 are closed. Depression of the trigger 338 forces the valve bodies 370, 372 to move, against the bias of the springs 378, 384, and the valve heads 376, 382 to unlock, unplug, or otherwise open the dispensing paths 52, 56 to the distributors 20, 24.

The valve bodies 370, 372 and/or the trigger 338 may have anti-rotation features to prevent rotation of either stem 374, 380 that could block flow internal to the valves 58, 60. The valve bodies 370, 372 may, for example, align with ribs 386 on an inner surface of the trigger 338 to prevent rotation. Additionally or alternatively, the valve bodies 370, 372 may have flats 388, 390, respectively that are engaged by the ribs 386 or another portion of the trigger 338 to prevent rotation.

Figure 23:
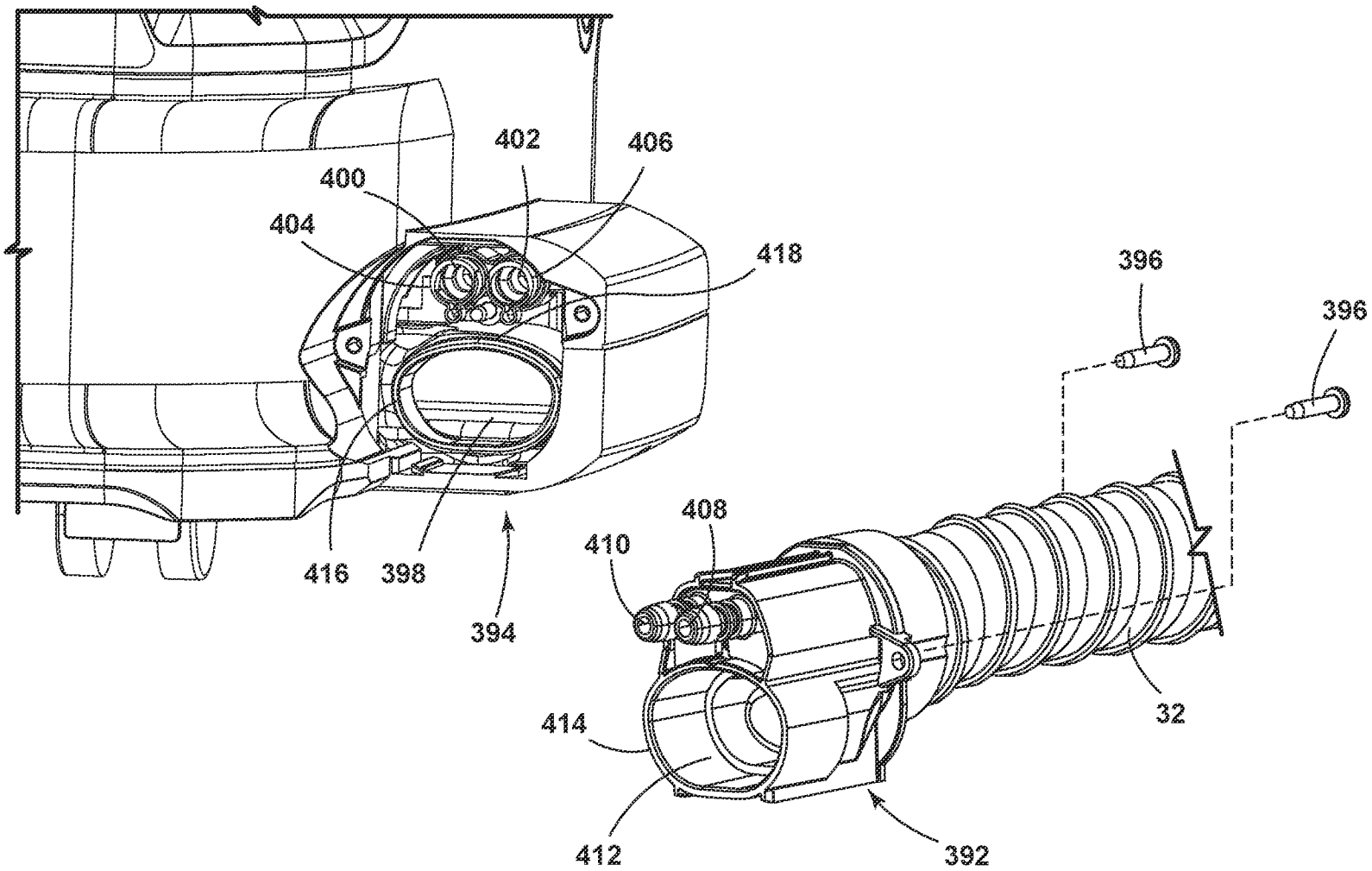
FIG. 23 is a close-up, perspective view showing another embodiment of a hose adaptor for the hose assembly and a hose coupler on the main housing.
Figure 24:
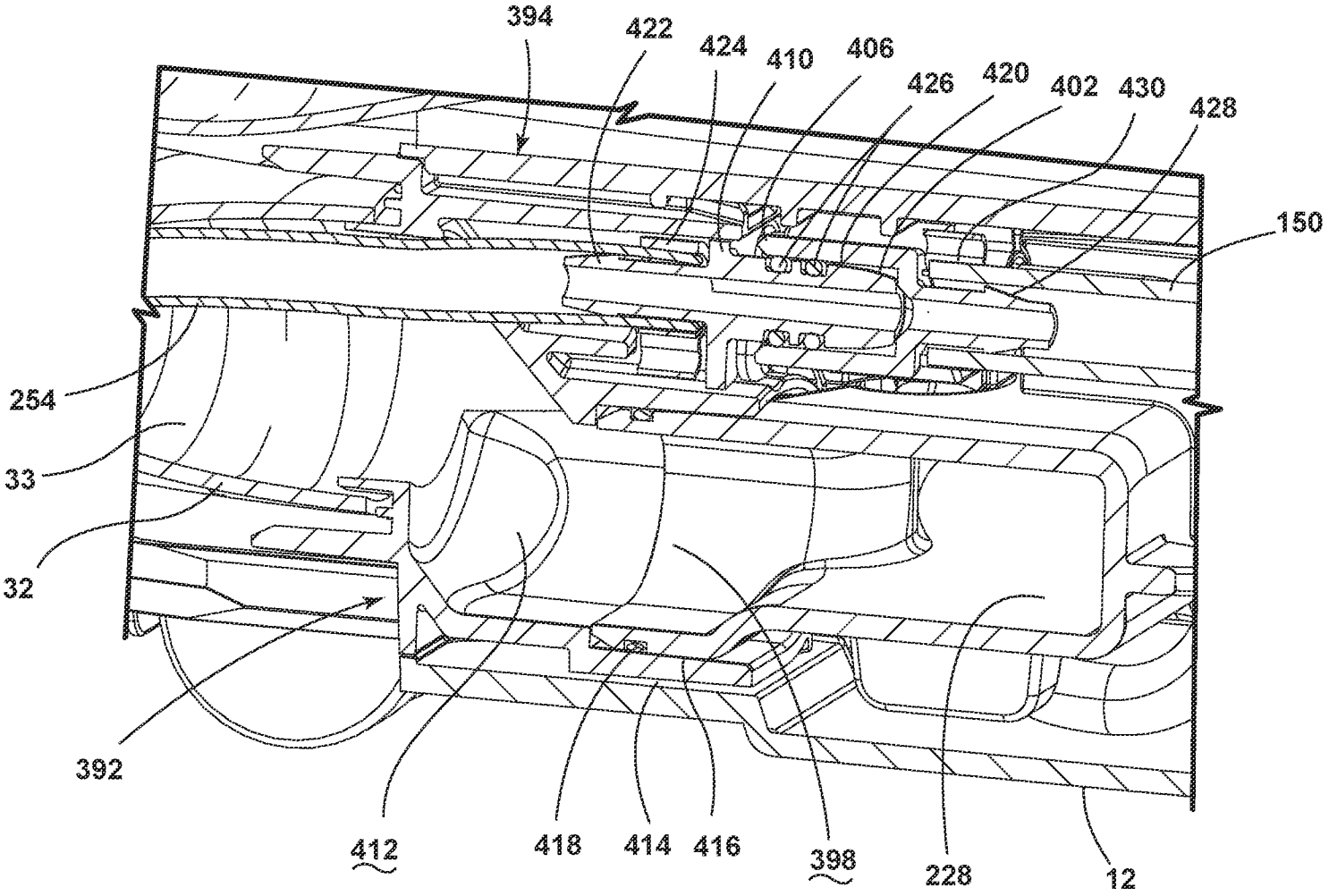
FIG. 24 is a close-up, sectional view showing the hose adaptor and the hose coupler of FIG. 23 coupled together.

FIGS. 23-24 show another embodiment of a hose adaptor 392 for the hose 32 and a hose coupler 394 for the main housing 12. In one embodiment, the hose adaptor 392 is not removable from the hose coupler 394 without the use of tools. For example, screws 396 or other fasteners can mount the hose adaptor 392 to the hose coupler 394, and thereby mount the hose 32 to the main housing 12. In another embodiment, the hose adaptor 392 can have a quick connect coupling with the hose coupler 394 or otherwise be connectable to the main housing 12 by hand, without the use of tools.

The hose coupler 394 includes a suction passage 398 in fluid communication with the hose inlet duct 228, a liquid passage 400 for the passage of liquid out of the pod 12, and a steam passage 402 for the passage of steam out of the pod 12. The passages 400, 402 can comprise female receivers 404, 406, respectively at an outlet or hose side of the hose coupler 394.

The hose adaptor 392 includes a liquid fitting 408 and a steam fitting 410 for the passage of liquid and steam through the adaptor 392, and a suction fitting 412 that fluidly couples the suction conduit 33 with the suction passage 398 of the hose coupler 394 to establish a continuous flow path therebetween.

The hose 32 may be held in place on the hose adaptor 392 by friction or mechanical interference. The hose 32 may be over-molded, glued, or otherwise additionally secured on the hose adaptor 392.

The suction fitting 412 on the hose adaptor 392 may be defined, at least in part, by a circumferential surface 414 with inside dimensions selected to fit on a circumferential surface 416 of the suction passage 398 of the hose coupler 394, such that at least a portion of the hose adaptor 392 is inserted over the hose coupler 394. A seal 418 may provide a fluid-tight interface between the suction passage 398 and suction fitting 412.

Where the circumferential surfaces 414, 416 are elliptical or oval-shaped, for example as shown in FIGS. 23-24, the circumferential surface 416 of the hose coupler 394 may have a short axis diameter and a long axis diameter selected to fit within a short axis diameter and a long axis diameter of the circumferential surface 414 of the hose adaptor 392. Other shapes for the suction passage 398 and fitting 412 are possible, including where the circumferential surfaces 414, 416 are annular or ring-shaped.

The steam fitting 410 and receiver 406 are shown in cross-section FIG. 24, and described herein, and it is understood that the liquid fitting 408 and receiver 404 may have an identical or substantially identical structure. On one side, the steam fitting 410 can comprise a male connector 420 insertable axially into the receiver 406 of the steam passage 402. On the other side, the steam fitting 410 can have a barbed end 422 or other structure to receive and retain thereon the hose steam conduit 254. A clamp 424 may secure the hose steam conduit 254 on the barbed end 422 of the fitting 410.

O-rings 426 or another sealing element can be provided at the interface between the fitting 410 and the steam passage 402 to prevent leakage of cleaning fluid at the interface. In illustrative embodiment, the O-rings 426 are carried on the male connector 420.

The steam receiver 406 can have a barbed end 428 or other structure to receive and retain thereon the steam supply conduit 150. A clamp 430 may secure the supply conduit 150 on the barbed end 428 of the receiver 406.

In the embodiment shown, at least some of the liquid- and/or steam-carrying components of the hose adaptor 392 and the hose coupler 394 are outside the recovery pathway and are not exposed to working air or dirty liquid flowing from the suction conduit 33 into the hose inlet duct 228. For example, the liquid passage 400, the steam passage 402, the liquid fitting 408, or the steam fitting 410, or any combination thereof, may be outside the recovery pathway. In one embodiment, the hose adaptor 392 comprises fitting 408, 410 that are outside the suction fitting 412, and may, for example, be disposed outside and/or above the circumferential surface 414 defining the suction fitting 412. In one embodiment, the hose coupler 394 comprises liquid and steam passages 400, 402 that are outside the suction passage 398, and may, for example, be disposed outside and/or above the circumferential surface 416 defining the suction passage 398.

While shown on a portable device adapted to be hand-carried by a user for cleaning relatively small areas, in other embodiments the functional systems of the surface cleaning apparatus with steam delivery can be arranged into other configurations, such as an upright device having a base and an upright body for directing the base across the surface to be cleaned, a canister device having a cleaning implement connected to a wheeled base by a vacuum hose, or a commercial device. Any of the aforementioned cleaners can be adapted to include a flexible vacuum hose, which can form a portion of the working air conduit between a nozzle and the suction source.

While the device is illustrated as an extraction cleaner, in other embodiments the surface cleaning apparatus with steam delivery can be a surface cleaning apparatus that has steam delivery capability but not extraction capabilities.

To the extent not already described, the different features and structures of the various embodiments of the present disclosure may be used in combination with each other as desired. Thus, the various features of the different embodiments may be mixed and matched as desired to form new embodiments, whether or not the new embodiments are expressly described.

Further aspects are provided by the subject matter of the following clauses:

A surface cleaning apparatus comprising a hand-carried body adapted to be hand-carried by a user, the hand-carried body comprising a supply tank, a recovery tank having a recovery container, a removable lid on the recovery container, an intake port in the lid, and an exhaust port in the lid, a liquid supply pump in fluid communication with the supply tank, a steam supply pump in fluid communication with the supply tank, a heater in fluid communication with the steam supply pump, and a suction source in fluid communication with the recovery tank, a flexible hose mounted to the hand-carried body, and a cleaning tool coupled with an end of the hose, wherein the hand-carried body comprises a recovery tank receiver having an intake duct in fluid communication with the hose and an exhaust duct in fluid communication with the suction source, whereby mounting of the recovery tank with the lid disposed thereon in the recovery tank receiver couples the intake port with the intake duct and the exhaust port with the exhaust duct.

The surface cleaning apparatus of any preceding clause, wherein the recovery container defines an internal volume for receiving and storing recovered liquid and dirt, and wherein the intake duct and exhaust duct are outside the internal volume.

The surface cleaning apparatus of any preceding clause, wherein the recovery tank is removably mounted on the hand-carried body and the intake duct and the exhaust duct are outside the recovery container, wherein the intake duct and the exhaust duct remain with the hand-carried body when the recovery tank is removed from on the hand-carried body.

The surface cleaning apparatus of any preceding clause, wherein the hand-carried body comprises a base adapted to rest on a floor surface and a partition extending upwardly from the base, wherein the intake duct and the exhaust duct extend upwardly from the base proximate the partition.

The surface cleaning apparatus of any preceding clause, wherein the hand-carried body comprises a hose inlet duct fluidly coupling the intake duct with the hose and a motor inlet duct fluidly coupling the exhaust duct with the suction source, wherein the hose inlet duct and motor inlet duct extend within the base.

The surface cleaning apparatus of any preceding clause, wherein the recovery container comprises a bottom wall and a side wall defining an open top, the lid selectively closing the open top, the side wall includes an internally-facing surface when the recovery tank is mounted in the recovery tank receiver, the internally-facing surface including a recessed section, and the intake and exhaust ducts nest within the recessed section when the recovery tank is mounted in the recovery tank receiver.

The surface cleaning apparatus of any preceding clause, wherein the recovery container comprises a bottom wall and a side wall defining an open top, the lid selectively closing the open top, the side wall includes a recessed section and the intake and exhaust ports open toward the recessed section.

The surface cleaning apparatus of any preceding clause, wherein the recovery tank comprises a pivoting handle attached to the lid.

The surface cleaning apparatus of any preceding clause, wherein the lid comprises a lid cover having a depending skirt configured to be received on the recovery container.

The surface cleaning apparatus of any preceding clause, wherein the lid comprises a frame coupled to the lid cover, wherein the frame supports the intake and exhaust ports below the lid cover and/or within a boundary defined by the skirt.

The surface cleaning apparatus of any preceding clause, wherein the lid comprises a lid cover and a frame coupled to the lid cover, and the intake and exhaust ports are formed in the frame.

The surface cleaning apparatus of any preceding clause, wherein the exhaust duct comprises a screen at an upper end thereof.

The surface cleaning apparatus of any preceding clause, wherein the hand-carried body comprises a hose inlet duct fluidly coupling the intake duct with the hose, and a motor inlet duct fluidly coupling the exhaust duct with the suction source, wherein the hose inlet duct and motor inlet duct extend below the recovery tank receiver.

The surface cleaning apparatus of any preceding clause, comprising a hose inlet duct fluidly coupling the intake duct with the hose, a pressure relief device in a fluid path between the supply tank and the hose, a bypass line fluidly coupling the pressure relief device to the recovery tank, wherein the pressure relief device diverts cleaning fluid from the fluid path through the bypass line at a set pressure, and wherein the bypass line is fluidly coupled with the hose inlet duct at a location upstream of an entrance into the intake duct.

A surface cleaning apparatus comprising a hand-carried body adapted to be hand-carried by a user, the hand-carried body comprising a supply tank, a recovery tank, a liquid supply pump in fluid communication with the supply tank, a steam supply pump in fluid communication with the supply tank, a heater in fluid communication with the steam supply pump, and a vacuum motor in fluid communication with the recovery tank, a flexible hose having a proximal end mounted to the hand-carried body and comprising a liquid conduit in fluid communication with the liquid supply pump, a steam conduit in fluid communication with the heater, and a suction conduit in fluid communication with the recovery tank, a wand coupled with a distal end of the hose, the wand comprising a liquid distributor to deliver liquid cleaning fluid and a steam distributor to deliver steam, and a tool head coupled with the wand and comprising an extraction nozzle to recover soiled cleaning fluid from the surface to be cleaned and a dispensing window, wherein the liquid and steam distributors of the wand are in register with the dispensing window of the tool head to deliver liquid and steam through the dispensing window.

The surface cleaning apparatus of any preceding clause, wherein the wand comprises a liquid valve to control a flow of cleaning liquid to the liquid distributor and a steam valve to control a flow of steam to the steam distributor.

The surface cleaning apparatus of any preceding clause, wherein the wand comprises a trigger controlling the liquid valve and the steam valve, wherein depressing the trigger opens both the liquid valve and the steam valve.

The surface cleaning apparatus of any preceding clause, wherein the wand comprises a trigger guard.

The surface cleaning apparatus of any preceding clause, wherein the wand comprises a wand body and at least one spring biasing the trigger outwardly from the wand body to an outwardly-biased position where the liquid and steam valves are closed, wherein the outwardly-biased position of the trigger defines a normal projection distance of the trigger from the wand body, and wherein the trigger guard extends from the wand body by a distance that is at least equal to the normal projection distance of the trigger from the wand body.

The surface cleaning apparatus of any preceding clause, wherein the wand comprises a dual-stem valve body coupled with a first valve head for the liquid valve and a second valve head for the steam valve.

The surface cleaning apparatus of any preceding clause, wherein the wand comprises a wand body, a suction passage through the wand body, a first conduit fluidly communicating an outlet of the liquid valve with the liquid distributor, and a second conduit fluidly communicating an outlet of the steam valve with the steam distributor, wherein the first conduit and the second conduit extend through the wand body in a cavity that is fluidly isolated from the suction passage.

The surface cleaning apparatus of any preceding clause, wherein the liquid and steam distributors are located on an underside of the wand, with the steam distributor separate from and proximate the liquid distributor, and wherein the dispensing window is located on an underside of the tool head.

The surface cleaning apparatus of any preceding clause, wherein the wand comprises a wand body, a hose collar at a proximal end of the wand body, and a tool connector at a distal end of the wand body, wherein a suction passage extends through the wand body from the hose collar to the tool connector.

The surface cleaning apparatus of any preceding clause, wherein the liquid and steam distributors are disposed on the tool connector at the distal end of the wand body.

The surface cleaning apparatus of any preceding clause, wherein the tool head comprises a tool body having the extraction nozzle at a distal end of the tool body and a wand connector at a proximal end of the tool body, and a suction passage extending through the tool body from the extraction nozzle to the wand connector, wherein the wand connector comprises the dispensing window.

The surface cleaning apparatus of any preceding clause, wherein the wand comprises a wand body and a tool connector at a distal end of the wand body, the liquid and steam distributors are disposed on the tool connector, and the wand connector comprises an inside diameter selected to fit on an outside diameter of the tool connector, whereby the wand connector at least partially overlaps the tool connector to align the liquid and steam distributors with the dispensing window.

The surface cleaning apparatus of any preceding clause, wherein the wand connector comprises a sidewall, and the dispensing window comprises an opening through the sidewall.

The surface cleaning apparatus of any preceding clause, wherein the tool head comprises a brush, wherein the dispensing window is located behind the brush.

The surface cleaning apparatus of any preceding clause, wherein the dispensing window is located behind the extraction nozzle.

The surface cleaning apparatus of any preceding clause, wherein the tool head is removably coupled with the wand.

The surface cleaning apparatus of any preceding clause, wherein the hand-carried body comprises a hose coupler and the proximal end of the hose comprises a hose adaptor connecting the hose to the hose coupler, wherein the hose coupler comprises a suction passage in fluid communication with the recovery tank, a liquid passage, and a steam passage.

The surface cleaning apparatus of any preceding clause, wherein the hose adaptor comprises a liquid fitting of the liquid conduit and a steam fitting of the steam conduit, wherein the liquid fitting is axially insertable into the liquid passage of the hose adaptor and the steam fitting is axially insertable into the steam passage of the hose adaptor.

A surface cleaning apparatus comprising a hand-carried body adapted to be hand-carried by a user, the hand-carried body comprising a supply tank, a recovery tank, a liquid supply pump in fluid communication with the supply tank, a steam supply pump in fluid communication with the supply tank, a heater in fluid communication with the steam supply pump, a vacuum motor in fluid communication with an outlet of the recovery tank, and a hose coupler comprising a suction passage in fluid communication with an inlet of the recovery tank, a liquid passage in fluid communication with the liquid supply pump, and a steam passage in fluid communication with the heater, a hose assembly coupled with the hand-carried body, the hose assembly comprising a hose adaptor removably coupled with the hose coupler, the hose adaptor comprising a suction fitting coupleable with the suction passage of the hose coupler to establish a continuous recovery path between the hand-carried body and the hose assembly, a liquid fitting coupleable with the liquid passage of the hose coupler to establish a continuous liquid flow path between the hand-carried body and the hose assembly, and a steam fitting coupleable with the steam passage of the hose coupler to establish a continuous steam flow path between the hand-carried body and the hose assembly, wherein the liquid and steam fittings are outside the recovery path.

The surface cleaning apparatus of any preceding clause, wherein the hose assembly is removably mounted to the hand-carried body.

The surface cleaning apparatus of any preceding clause, wherein the liquid and steam passages of the hose coupler are outside the suction passage.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. A surface cleaning apparatus comprising:

a hand-carried body adapted to be hand-carried by a user, the hand-carried body comprising:

a base adapted to rest on a floor surface;

a partition extending upwardly from the base;

a supply tank removably mounted to the hand-carried body on a first side of the partition;

a recovery tank removably mounted to the hand-carried body on a second side of the partition;

a liquid supply pump in fluid communication with the supply tank;

a steam supply pump in fluid communication with the supply tank;

a heater in fluid communication with the steam supply pump; and a vacuum motor in fluid communication with the recovery tank;

a flexible hose mounted to the hand-carried body and comprising a liquid conduit in fluid communication with the liquid supply pump, a steam conduit in fluid communication with the heater, and a suction conduit in fluid communication with the recovery tank; and a cleaning tool coupled with an end of the hose and comprising a liquid distributor to deliver liquid cleaning fluid, a steam distributor to deliver steam, and an extraction nozzle to recover soiled cleaning fluid from the surface to be cleaned;

wherein the heater and the vacuum motor are at least partially disposed within the partition, and are disposed between the supply tank and the recovery tank;

wherein the heater comprises an upper end, a lower end, a heater inlet in fluid communication with the supply tank and a heater outlet in fluid communication with the steam conduit of the flexible hose; and wherein the heater is oriented with the lower end of the heater toward the base and the upper end of the heater farther from the base than the lower end of the heater, and the heater inlet and the heater outlet are disposed at the lower end of the heater.

2. The surface cleaning apparatus of claim 1, wherein the heater is disposed in a heater cavity on the hand-carried body, wherein the heater cavity is disposed partially in the base and partially in the partition.

3. The surface cleaning apparatus of claim 2, wherein the heater inlet and the heater outlet are disposed at lower end of the heater cavity.

4. The surface cleaning apparatus of claim 1, wherein the vacuum motor is disposed in a motor cavity on the hand-carried body, wherein the motor cavity is disposed partially in the base and partially in the partition.

5. The surface cleaning apparatus of claim 1, wherein:

the hand-carried body comprises a front side, a rear side opposite the front side, a first horizontal longitudinal axis from the front side to the rear side, a first lateral side disposed between the front side and the rear side, a second lateral side disposed between the front side and the rear side, and a second horizontal longitudinal axis from the first lateral side to the second lateral side;

the supply tank is disposed on a first side of the first horizontal longitudinal axis;

the recovery tank is disposed on a second side of the first horizontal longitudinal axis;

the heater is disposed on one side of the second horizontal longitudinal axis; and at least a majority of the vacuum motor is disposed on an opposing side of the second horizontal longitudinal axis.

6. The surface cleaning apparatus of claim 1, wherein the base has a first zone, a second zone, and a third zone arranged along a horizontal axis;

wherein the first zone includes a supply tank seat configured to receive the supply tank;

wherein the second zone is coupled with the partition;

wherein the third zone includes a recovery tank seat configured to receive the recovery tank;

wherein the horizontal axis defines a vertical plane through the first, second, and third zones; and wherein the heater is disposed on one side of the vertical plane and at least a portion of the vacuum motor is disposed on the opposite side of the vertical plane.

7. A surface cleaning apparatus comprising:

a hand-carried body adapted to be hand-carried by a user, the hand-carried body comprising:

a base adapted to rest on a floor surface;

a partition extending upwardly from the base;

a supply tank removably mounted to the hand-carried body on a first side of the partition;

a recovery tank removably mounted to the hand-carried body on a second side of the partition;

a liquid supply pump in fluid communication with the supply tank;

a steam supply pump in fluid communication with the supply tank;

a heater in fluid communication with the steam supply pump; and a vacuum motor in fluid communication with the recovery tank;

a flexible hose mounted to the hand-carried body and comprising a liquid conduit in fluid communication with the liquid supply pump, a steam conduit in fluid communication with the heater, and a suction conduit in fluid communication with the recovery tank; and a cleaning tool coupled with an end of the hose and comprising a liquid distributor to deliver liquid cleaning fluid, a steam distributor to deliver steam, and an extraction nozzle to recover soiled cleaning fluid from the surface to be cleaned;

wherein the heater and the vacuum motor are at least partially disposed within the partition, and are disposed between the supply tank and the recovery tank;

wherein the liquid supply pump and the steam supply pump are disposed in the base and are arranged on opposing sides of the heater; and wherein one of the liquid supply pump and the steam supply pump is disposed below the supply tank and the other one of the liquid supply pump and the steam supply pump is disposed below the recovery tank.

8. The surface cleaning apparatus of claim 1, wherein the heater comprises an electric heating element and a fluid-conducting tube encased in a thermally conductive body with the electric heating element.

9. The surface cleaning apparatus of claim 8, wherein the fluid-conducting tube comprises two spaced tube portions and a bend between the two tube portions, wherein the bend is disposed within the partition at the upper end of the heater.

10. The surface cleaning apparatus of claim 1, wherein the hand-carried body comprises a carry handle on an upper portion of the partition, and the heater and the vacuum motor are positioned below the carry handle.

11. The surface cleaning apparatus of claim 7, wherein:

the heater comprises an upper end, a lower end, a heater inlet in fluid communication with the supply tank and a heater outlet in fluid communication with the steam conduit of the flexible hose; and the heater is oriented with the lower end of the heater toward the base and the upper end of the heater farther from the base than the lower end of the heater, and the heater inlet and the heater outlet are disposed at the lower end of the heater.

12. The surface cleaning apparatus of claim 7, wherein the heater is disposed in a heater cavity on the hand-carried body, wherein the heater cavity is disposed partially in the base and partially in the partition.

13. The surface cleaning apparatus of claim 12, wherein the heater comprises a heater inlet in fluid communication with the supply tank and a heater outlet in fluid communication with the steam conduit of the flexible hose, and the heater inlet and the heater outlet are disposed at lower end of the heater cavity.

14. The surface cleaning apparatus of claim 7, wherein the vacuum motor is disposed in a motor cavity on the hand-carried body, wherein the motor cavity is disposed partially in the base and partially in the partition.

15. The surface cleaning apparatus of claim 7, wherein:

the hand-carried body comprises a front side, a rear side opposite the front side, a first horizontal longitudinal axis from the front side to the rear side, a first lateral side disposed between the front side and the rear side, a second lateral side disposed between the front side and the rear side, and a second horizontal longitudinal axis from the first lateral side to the second lateral side;

the supply tank is disposed on a first side of the first horizontal longitudinal axis;

the recovery tank is disposed on a second side of the first horizontal longitudinal axis;

the heater is disposed on one side of the second horizontal longitudinal axis; and at least a majority of the vacuum motor is disposed on an opposing side of the second horizontal longitudinal axis.

16. The surface cleaning apparatus of claim 7, wherein the heater comprises an electric heating element and a fluid-conducting tube encased in a thermally conductive body with the electric heating element.

17. The surface cleaning apparatus of claim 16, wherein:

the heater comprises an upper end, a lower end, a heater inlet in fluid communication with the supply tank and a heater outlet in fluid communication with the steam conduit of the flexible hose;

the heater inlet is disposed at the lower end of the heater; and the fluid-conducting tube comprises two spaced tube portions and a bend between the two tube portions, wherein the bend is disposed within the partition at the upper end of the heater.

18. The surface cleaning apparatus of claim 7, wherein the hand-carried body comprises a carry handle on an upper portion of the partition, and the heater and the vacuum motor are positioned below the carry handle.

19. The surface cleaning apparatus of claim 18, wherein the base has a first zone, a second zone, and a third zone arranged along a horizontal axis;

wherein the first zone includes a supply tank seat configured to receive the supply tank and a space below the supply tank seat for the one of the liquid supply pump and the steam supply pump;

wherein the second zone is coupled with the partition;

wherein the third zone includes a recovery tank seat configured to receive the recovery tank and a space below the recovery tank seat for the other one of the liquid supply pump and the steam supply pump is disposed below the recovery tank;

wherein the carry handle is aligned with the second zone; and wherein the horizontal axis defines a vertical plane through the first, second, and third zones, and the heater is disposed on one side of the vertical plane.

* * * * *